US010890856B2

(12) United States Patent
Shindo

(10) Patent No.: US 10,890,856 B2
(45) Date of Patent: Jan. 12, 2021

(54) IMAGE FORMING APPARATUS, METHOD OF CONTROLLING THE SAME, AND STORAGE MEDIUM

(71) Applicant: CANON KABUSHIKI KAISHA, Tokyo (JP)

(72) Inventor: Yukihiro Shindo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/545,360

(22) Filed: Aug. 20, 2019

(65) Prior Publication Data

US 2020/0073276 A1 Mar. 5, 2020

(30) Foreign Application Priority Data

Aug. 29, 2018 (JP) ..... 2018-160600

(51) Int. Cl.
*G03G 15/04* (2006.01)
*G03G 15/043* (2006.01)
*G03G 15/01* (2006.01)

(52) U.S. Cl.
CPC ... *G03G 15/04027* (2013.01); *G03G 15/0115* (2013.01); *G03G 15/043* (2013.01); *G03G 15/04018* (2013.01); *G03G 15/04054* (2013.01)

(58) Field of Classification Search
CPC ..... G03G 15/011; G03G 15/0115; G03G 15/04018; G03G 15/04027; G03G 15/04054; G03G 15/04063; G03G 15/043
See application file for complete search history.

(56) References Cited

U.S. PATENT DOCUMENTS 6,177,948 B1 * 1/2001 Estabrooks ..... B41J 2/385 347/129
8,184,332 B2 5/2012 Inoue et al.
2005/0134677 A1 6/2005 Kawasaki et al.
2010/0157377 A1 * 6/2010 Zhao ..... B42D 25/333 358/3.28
2014/0049552 A1 * 2/2014 Narumi ..... G03G 15/043 345/581
2017/0201643 A1 7/2017 Shiraishi et al.

FOREIGN PATENT DOCUMENTS

JP 2007-237412 A 9/2007

OTHER PUBLICATIONS

Extended European Search Report dated Jan. 29, 2020, in European Patent Application No. 19190952.2.

* cited by examiner

*Primary Examiner* — Joseph S Wong
(74) *Attorney, Agent, or Firm* — Venable LLP

(57) ABSTRACT

An image forming apparatus includes a printer unit that prints an image on a sheet using a line head in which a plurality of light emitting devices are arranged, and a storage unit that stores information regarding light amounts corresponding to the light emitting devices of the line head. The image forming apparatus generates a mask pattern based on the information regarding the light amounts obtained from the storage unit and a target light amount, and executes mask processing on halftone image data that is in positional correspondence with the light emitting devices using the generated mask pattern.

11 Claims, 16 Drawing Sheets

FIG. 12

| TARGET LIGHT AMOUNT | 85 |
|---|---|

| ChipNo | Chip1 | | | | | | | | | | | | | | | | Chip2 | | | | | | | | | | | | | | | | | | ... |
|---|---|---|---|---|---|---|---|---|---|---|---|---|---|---|---|---|---|---|---|---|---|---|---|---|---|---|---|---|---|---|---|---|---|---|---|
| MAIN SCANNING POSITION | 0 | ... | 64 | ... | 128 | ... | 192 | ... | 256 | ... | 320 | ... | 384 | ... | 448 | ... | 512 | ... | 576 | ... | 640 | ... | 704 | ... | 768 | ... | 832 | ... | 896 | ... | 960 | ... | ... |
| LIGHT AMOUNT | 88 | | 88.2 | | 89 | | 90 | | 89.8 | | 89.2 | | 88.7 | | 88.8 | | 92.3 | | 92 | | 91.5 | | 91 | | 90.5 | | 90.3 | | 90.8 | | 91 | | |
| LIGHT AMOUNT DECREASE RATE TO TARGET LIGHT AMOUNT | 3 | | 3.2 | | 4 | | 5 | | 4.8 | | 4.2 | | 3.7 | | 3.8 | | 7.3 | | 7 | | 6.5 | | 6 | | 5.5 | | 5.3 | | 5.8 | | 6 | | |

MATRIX SIZE : 256×128
SHIFT AMOUNT : 129
※ SHIFT AMOUNT AND MATRIX WIDTH ARE MUTUALLY PRIME

MAIN SCANNING DIRECTION →
SUB-SCANNING DIRECTION ↓

| | | | | | | | | | | | | | | | | | |
|---|---|---|---|---|---|---|---|---|---|---|---|---|---|---|---|---|---|
| 757 | 341 | 636 | 284 | 791 | 662 | 559 | 452 | 866 | 697 | 509 | 806 | 723 | 315 | 563 | 455 | ... | |
| 97 | 946 | 182 | 9 | 402 | 969 | 142 | 812 | 50 | 286 | 594 | 162 | 59 | 643 | 1011 | 264 | | |
| 797 | 455 | 681 | 840 | 520 | 82 | 253 | 387 | 952 | 204 | 922 | 409 | 853 | 495 | 185 | 95 | | |
| 369 | 905 | 223 | 586 | 331 | 884 | 629 | 734 | 548 | 469 | 765 | 113 | 342 | 935 | 707 | 589 | | |
| 294 | 718 | 123 | 977 | 755 | 481 | 178 | 1005 | 310 | 17 | 673 | 609 | 226 | 798 | 27 | 362 | | |
| 1010 | 499 | 54 | 415 | 269 | 34 | 701 | 110 | 825 | 372 | 869 | 996 | 435 | 285 | 524 | 977 | | |
| 246 | 575 | 860 | 638 | 820 | 941 | 434 | 591 | 231 | 516 | 157 | 69 | 562 | 687 | 123 | 844 | | |
| 89 | 775 | 153 | 371 | 205 | 543 | 294 | 886 | 651 | 929 | 728 | 332 | 813 | 190 | 939 | 732 | | |
| 473 | 890 | 320 | 992 | 674 | 85 | 798 | 392 | 48 | 466 | 270 | 968 | 631 | 479 | 380 | 46 | | |
| 195 | 622 | 520 | 1 | 457 | 731 | 148 | 1022 | 198 | 777 | 111 | 411 | 15 | 891 | 254 | 581 | | |
| 48 | 707 | 257 | 807 | 900 | 586 | 343 | 512 | 705 | 600 | 846 | 549 | 696 | 164 | 752 | 955 | | |
| 987 | 422 | 935 | 112 | 395 | 218 | 959 | 29 | 284 | 916 | 355 | 223 | 1002 | 306 | 832 | 72 | | |
| 778 | 157 | 563 | 656 | 301 | 764 | 855 | 636 | 426 | 137 | 485 | 56 | 615 | 424 | 521 | 362 | | |
| 611 | 361 | 845 | 63 | 496 | 168 | 551 | 92 | 815 | 977 | 668 | 884 | 790 | 106 | 715 | 873 | | |
| 27 | 725 | 244 | 1000 | 695 | 942 | 452 | 250 | 723 | 315 | 175 | 536 | 265 | 964 | 196 | 475 | | |
| 456 | 922 | 530 | 418 | 330 | 38 | 892 | 378 | 590 | 7 | 754 | 406 | 348 | 33 | 583 | 916 | | |
| ... | | | | | | | | | | | | | | | | | |
| | | | | | | | | | | | | | | | | | |

THRESHOLD MATRIX FOR GENERATING MASK PATTERN

THRESHOLD MATRIX IS REFERENCED BY SHIFTING

FIG. 13C

MAIN SCANNING POSITION : 0
LIGHT AMOUNT DECREASE RATE : 3%
LIGHT AMOUNT DECREASE SIGNAL : 31(10bit)

MAIN SCANNING POSITION : 256
LIGHT AMOUNT DECREASE RATE : 4.8%
LIGHT AMOUNT DECREASE SIGNAL : 49(10bit)

MAIN SCANNING DIRECTION

SUB-SCANNING DIRECTION

| | | | | |
|---|---|---|---|---|
| 757 | 341 | 636 | 284 | 791 |
| 97 | 946 | 182 | 9 | 402 |
| 797 | 455 | 681 | 840 | 520 |
| 369 | 905 | 223 | 586 | 331 |
| 294 | 718 | 123 | 977 | 755 |
| 1010 | 499 | 54 | 415 | 269 |
| 246 | 575 | 860 | 638 | 820 |
| 89 | 775 | 153 | 371 | 205 |
| 473 | 890 | 320 | 992 | 674 |
| 195 | 622 | 520 | 1 | 457 |
| 48 | 707 | 257 | 807 | 900 |
| 987 | 422 | 935 | 112 | 395 |
| 778 | 157 | 563 | 656 | 301 |
| 611 | 361 | 845 | 63 | 496 |
| 27 | 725 | 244 | 1000 | 695 |
| 456 | 922 | 530 | 418 | 330 |
| ... | | | | |

...

| | | | | |
|---|---|---|---|---|
| 757 | 341 | 636 | 284 | 791 |
| 97 | 946 | 182 | 9 | 402 |
| 797 | 455 | 681 | 840 | 520 |
| 369 | 905 | 223 | 586 | 331 |
| 294 | 718 | 123 | 977 | 755 |
| 1010 | 499 | 54 | 415 | 269 |
| 246 | 575 | 860 | 638 | 820 |
| 89 | 775 | 153 | 371 | 205 |
| 473 | 890 | 320 | 992 | 674 |
| 195 | 622 | 520 | 1 | 457 |
| 48 | 707 | 257 | 807 | 900 |
| 987 | 422 | 935 | 112 | 395 |
| 778 | 157 | 563 | 656 | 301 |
| 611 | 361 | 845 | 63 | 496 |
| 27 | 725 | 244 | 1000 | 695 |
| 456 | 922 | 530 | 418 | 330 |
| ... | | | | |

...

LIGHT AMOUNT DECREASE RATE IS 4.8% AT MAIN SCANNING POSITION 256 FOR EXAMPLE, WHEN REPETITION CYCLE OF THRESHOLDS IN SUB-SCANNING DIRECTION OF THRESHOLD MATRIX IS 1000 PIXELS, MASKING PROCESSING IN 48 PIXELS OUT OF 1000 PIXELS IS PERFORMED

LIGHT AMOUNT DECREASE RATE IS 3.0% AT MAIN SCANNING POSITION 0 FOR EXAMPLE, WHEN REPETITION CYCLE OF THRESHOLDS IN SUB-SCANNING DIRECTION OF THRESHOLD MATRIX IS 1000 PIXELS, MASKING PROCESSING IN 30 PIXELS OUT OF 1000 PIXELS IS PERFORMED

LIGHT AMOUNT DECREASE RATES AT MAIN SCANNING POSITIONS AND THRESHOLD MATRIX

IMAGE AFTER MASK PROCESSING
(IMAGE AFTER HT DENSITY CORRECTION)

IMAGE DATA AFTER PSEUDO
RESOLUTION CONVERSION

IMAGE FORMING APPARATUS, METHOD OF CONTROLLING THE SAME, AND STORAGE MEDIUM

BACKGROUND OF THE INVENTION

Field of the Invention

The present invention relates to an image forming apparatus, a method of controlling the same, and a storage medium.

Description of the Related Art

Commonly, electrophotographic printers include a photosensitive member, which is an image carrier having a photosensitive layer on its outer peripheral surface, a charge device that uniformly charges the outer peripheral surface of the photosensitive member, an exposure device that selectively exposes the outer peripheral surface of the uniformly charged photosensitive member, and forms an electrostatic latent image, and a developer that supplies toner to the electrostatic latent image formed through exposure, and make it a visible image (toner image).

In tandem type image forming apparatuses for printing color images, there is an intermediate-transfer-belt-type image forming apparatus in which a plurality of image forming units (e.g., four image forming units in correspondence with four colors) each constituted by a plurality of units described above are arranged relative to an intermediate transfer belt. Also, toner images formed by four monochrome toner image forming units are transferred sequentially to the intermediate transfer belt, and, the toner images of a plurality of colors (for example, yellow (Y), magenta (M), cyan (C), and black (K)) are overlaid on the intermediate transfer belt so as to obtain a color image.

There is a known LED line head that is used in such tandem type image forming apparatuses, and in which LEDs or organic EL elements are used as light emitting devices. In such an optical-writing-type line head in which LEDs or the like are used as light sources, the light amounts of a plurality of LED light sources (light emitting devices) are not uniform, and thus, if writing is performed in this state, there is a problem in that an image formed by those LED light sources includes contrasting density (streaks/unevenness) that is based on the light amounts.

Conventionally, a correction circuit that corrects a light amount of each of a plurality of light sources provided in correspondence with pixels while data is being written, and uniformizes the density is provided in order to prevent such difference or contrasting density from occurring. Such correction of light amounts has been performed by changing an illumination time of each light source and a driving current. In order to correct light amounts, a following configuration has been adopted in which, before shipment of the line head, the light amounts of the light sources are measured and correction values for illumination times and driving currents for the pixels are written in a memory incorporated in the line head, and, while the line head is being used, in other words, while an image is being written, the correction values are read out, and the illumination times and driving electric currents are corrected.

However, in conventional methods, a circuit for controlling illumination times and driving currents for the pixels, besides for illumination control of pixels that is based on image data to be printed, has been necessary in order to uniformize the light amounts of the pixels, thus increasing the scale of the circuit. Japanese Patent Laid-Open No. 2007-237412 proposes a technique for suppressing an increase in the scale of the circuit, and preventing density unevenness due to non-uniformity of the light amounts, in an image forming apparatus equipped with a LED line head or another type of line head. In Japanese Patent Laid-Open No. 2007-237412, the densities of images of colors acquired through color-separation are corrected based on light amount property data for each pixel. Note that, density correction is performed while changing the degree of correction according to the density in a multi-value image before halftone processing. In addition, if the main scanning positions of pixels of an actual line head and the main scanning positions in an image to be subjected to density correction are deviated from each other, appropriate correction cannot be performed, and thus image positions are corrected before density correction.

However, in the above-described conventional method, since density correction that is appropriate for light amount property for each main scanning position is performed on a multi-value image data having the same resolution as the print resolution of the LED line head, and thus, if the print resolution is high, a necessary memory capacity of a line buffer increases. Additionally, in density correction processing, it is required to hold density correction tables that are different for respective main scanning positions at the print resolution. In addition, position correction is necessary in a multi-value image data before density correction, and thus a capacity of the line buffer required for accurately performing position correction at a high resolution increases, and it has been difficult to sufficiently reduce the scale of the circuit including position correction processing.

In addition, in the method of Japanese Patent Laid-Open No. 2007-237412, adjustment of image positions is carried out on multi-value image data before density correction. There has been a problem in that, if position adjustment for correcting magnification change (distortion) during printing is performed on multi-value image data, a halftone dot pattern after halftone processing is distorted due to the magnification change (distortion) when the data is being printed.

SUMMARY OF THE INVENTION

An aspect of the present invention is to eliminate the above-mentioned problem with conventional technology.

A feature of the present invention is to provide a technique that can suppress a necessary capacity of a memory, and prevent occurrence of density unevenness due to differences in light amounts of light emitting devices.

According to a first aspect of the present invention, there is provided an image forming apparatus comprising: a printer unit that prints an image on a sheet using a line head in which a plurality of light emitting devices are arranged; a storage that stores information regarding light amounts corresponding to the light emitting devices of the line head; a memory that stores instructions; and a processor that executes the instructions stored in the memory to: generate a mask pattern based on the information regarding the light amounts obtained from the storage and a target light amount, and execute mask processing on halftone image data that is in positional correspondence with the light emitting devices, using the generated mask pattern.

According to a second aspect of the present invention, there is provided a method of controlling an image forming apparatus that includes a line head in which a plurality of light emitting devices are arranged and a memory that stores information regarding light amounts corresponding to the light emitting devices of the line head, and forms an image using the line head, the method comprising: generating a mask pattern based on the information regarding the light amounts obtained from the memory and a target light amount, and executing mask processing on halftone image data that is in positional correspondence with the light emitting devices, using the mask pattern generated in the generating.

According to a third aspect of the present invention, there is provided a non-transitory computer-readable storage medium storing a program for causing a processor to execute a method of controlling an image forming apparatus that includes a line head in which a plurality of light emitting devices are arranged and a memory that stores information regarding light amounts corresponding to the light emitting devices of the line head, and forms an image using the line head, the method comprising: generating a mask pattern based on the information regarding the light amounts obtained from the memory and a target light amount, and executing mask processing on halftone image data that is in positional correspondence with the light emitting devices, using the mask pattern generated in the generating.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 12 is a diagram showing light amount decrease rates necessary for achieving the target light amount at main scanning positions.

FIGS. 13A to 13C are diagrams illustrating generation of a mask pattern in the first embodiment.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

In a first embodiment to be described below, information regarding the light amounts of light emitting devices of an LED line head is measured and stored in advance, and, when printing is performed, a mask pattern is generated based on the information regarding the light amounts of the light emitting devices, and mask processing is performed on image data that underwent halftone processing, whereby density correction is performed. An image forming apparatus that prevents, through the above-described density correction, density unevenness and streaks due to differences in light amounts of the light emitting devices from occurring will be described.

First Embodiment

Figure 1:
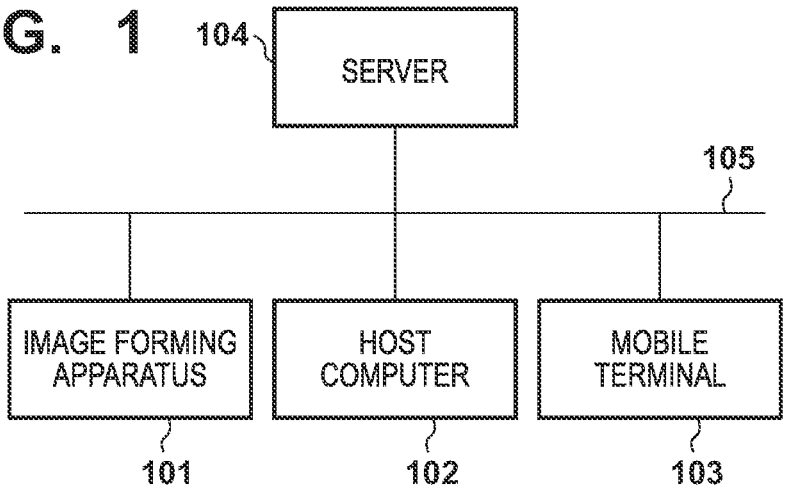
FIG. 1 is a diagram showing the configuration of a printing system that includes an image forming apparatus according to a first embodiment of the present invention.

FIG. 1 is a diagram showing the configuration of a printing system that includes an image forming apparatus 101 according to a first embodiment of the present invention.

This image forming apparatus 101 forms (prints) an image in an electrophotographic process as will be described later with reference to FIG. 2, for example. The image forming apparatus 101 receives image data from a host computer 102, a mobile terminal 103, a server 104, another image processing apparatus (not illustrated), or the like via a network 105, and executes printing (forms an image). In addition, a copy operation can be realized when image data obtained by an image reading apparatus (scanner) of the image forming apparatus 101 reading a document is printed using a print unit of the image forming apparatus 101.

Note that, in the following description, a configuration is adopted in which the image forming apparatus 101 carries out halftone processing on image data, but the present invention is not limited to such a configuration, and image processing such as halftone processing may be carried out by the host computer 102 that has transmitted the image data, or the like. Alternatively, this image processing may be divided such that the image forming apparatus 101 cooperates with the host computer 102, the mobile terminal 103, the server 104, or the like that has transmitted image data.

Figure 2:
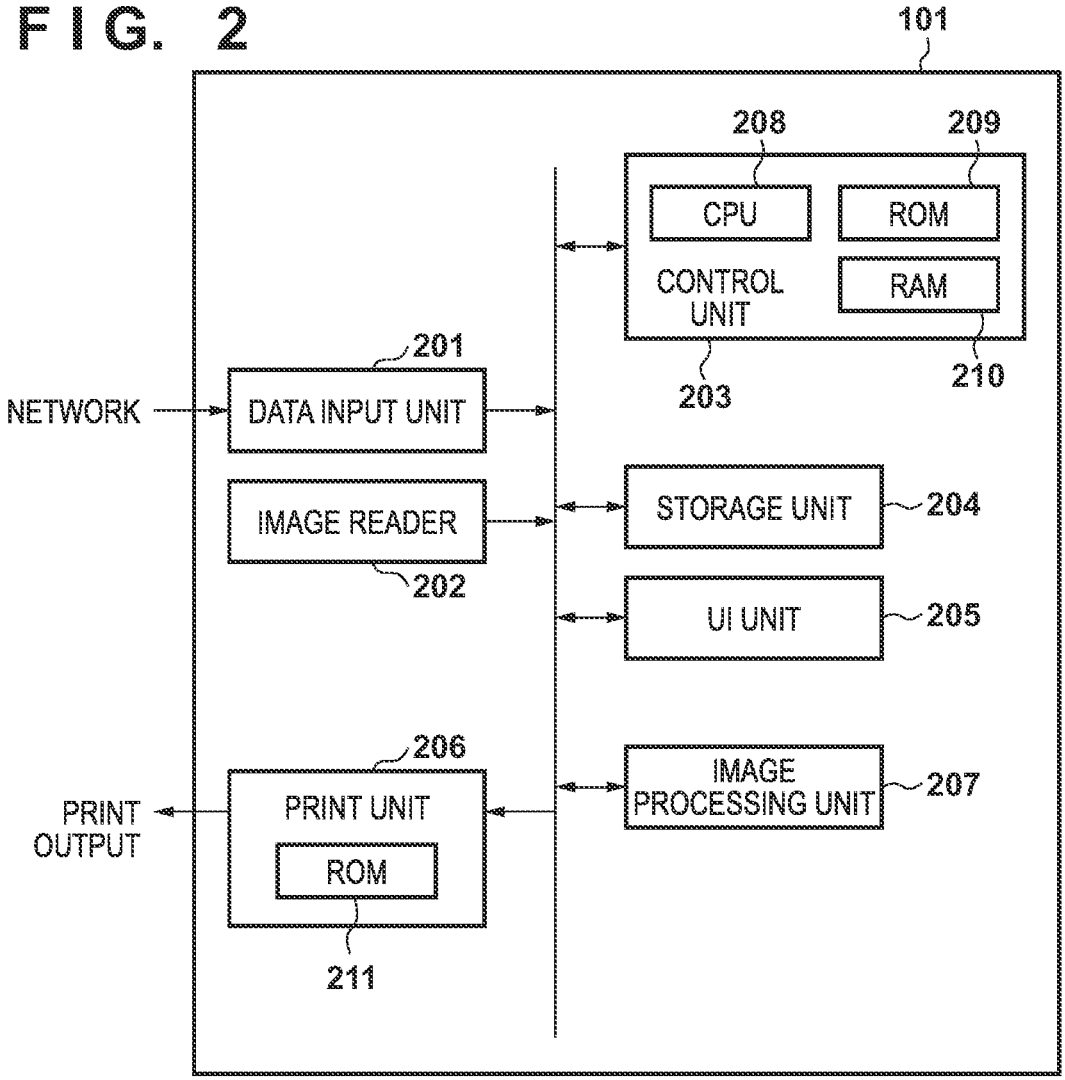
FIG. 2 is a block diagram for describing the hardware configuration of the image forming apparatus according to the first embodiment.

FIG. 2 is a block diagram for describing the hardware configuration of the image forming apparatus 101 according to the first embodiment.

The image forming apparatus 101 includes a data input unit (receiving unit) 201, an image reader 202, a control unit 203, a storage unit 204, UI (user interface) unit 205, a print unit 206, and an image processing unit 207. For example, the data input unit 201 receives, via the network 105, printing data transmitted from the server 104, for example, and inputs the printing data. The image reader 202 has a scanner, and reads an image of a document and outputs image data of the image. The control unit 203 controls an operation of this image forming apparatus 101, and has a CPU 208, a ROM 209, and a RAM 210. The CPU 208 executes a program stored in the ROM 209 so as to execute processes explained in the respective flowcharts to be described later. The storage unit 204 is a hard disk drive (HDD), for example, and can store a large volume of data. Note that a configuration may also be adopted in which the processes to be described later are executed by the CPU 208 deploying programs stored in this storage unit 204 to the RAM 210, and executing the deployed programs. The UI (user interface) unit 205 includes an operation panel and a display unit, and displays messages to the user, and receives an operation instruction from the user. Note that this UI unit 205 may also be provided with a touch panel function.

The print unit 206 is a printer engine, and, in the first embodiment, forms an image on paper (sheet) by overlaying toner images of a plurality of colors (e.g., CMYK) in an electrophotographic manner and in a tandem manner, but there is no limitation thereto. In addition, in the first embodiment, a description will be given assuming that a configuration is adopted in which the print resolution is 1200 dpi in the main scanning direction and the sub-scanning direction, and light emission timings of a light emitting device can be finely divided through PWM control, but there is no limitation thereto.

The print unit 206 also includes a ROM 211 for each of the line heads for the respective colors that are used for control of exposure to the photosensitive member. This ROM 211 stores information regarding differences in the individual line head that occurred during manufacturing, such as information regarding the light amounts of light emitting devices (LED), assembling positions of LED chips, and skew information, which were measured using a jig in a manufacturing process such as a line head manufacturing process.

The image processing unit 207 performs image processing on image data included in printing data that has been input. Note that the image processing unit 207 may also be a processing unit realized by specialized items of hardware, or a configuration may also be adopted in which the functions of the image processing unit 207 are realized by the CPU 208 executing the above-mentioned programs.

Next, function setting during printing will be described.

Figure 5:
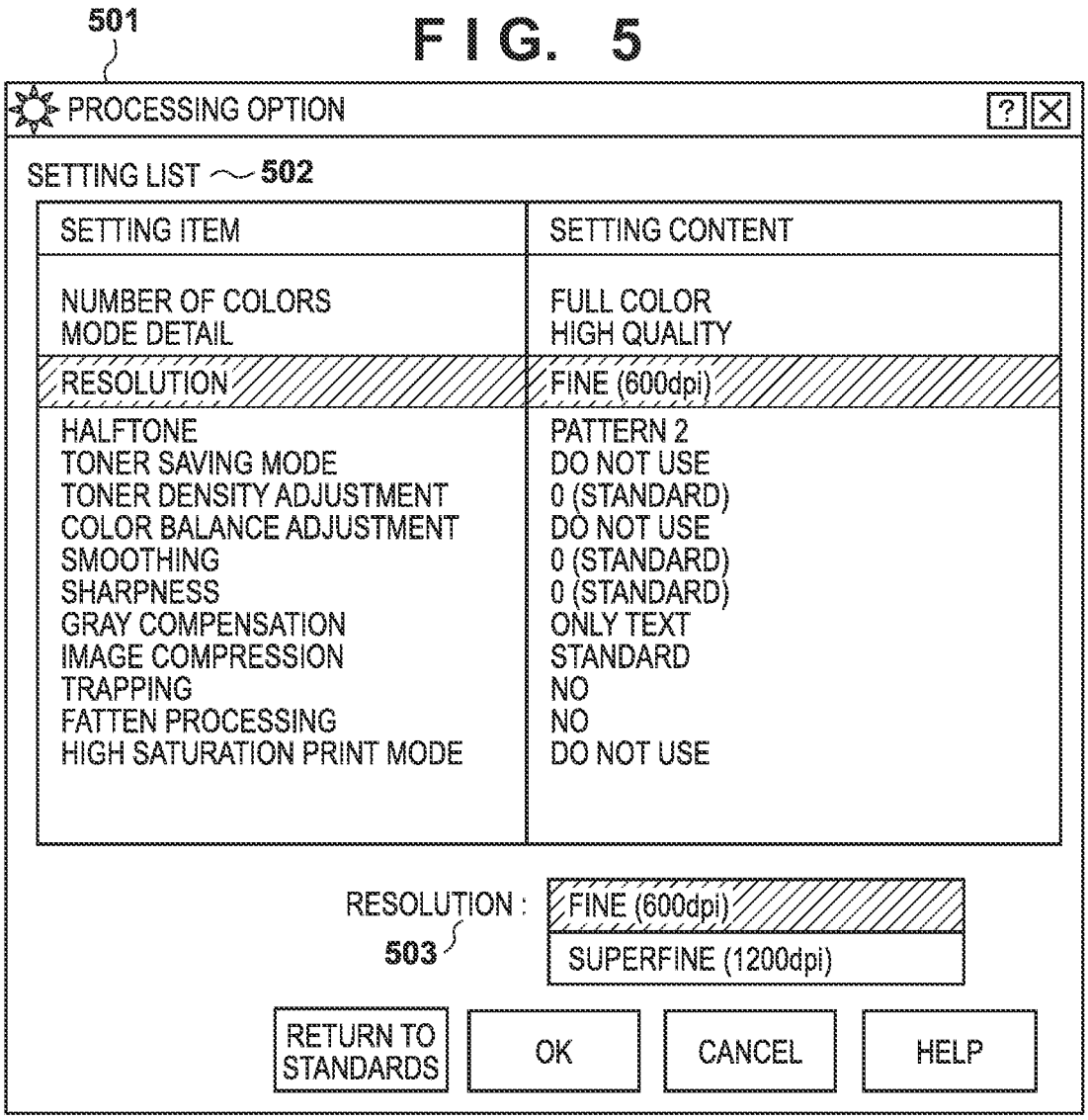
FIG. 5 is a diagram showing an example of a function setting screen that is displayed on a UI unit of the image forming apparatus according to the first embodiment.

FIG. 5 is a diagram showing an example of a function setting screen 501 that is displayed on the UI unit 205 of the image forming apparatus 101 according to the first embodiment. Note that this function setting screen 501 may be displayed on a UI unit (not illustrated) by a printer driver, an application, or the like installed in the host computer 102, the mobile terminal 103, or the server 104.

A list of setting items of functions that can be designated as an option and the current setting contents are displayed in a setting list 502. An item selected in the setting list 502 is displayed in a selected item 503, and the setting content of the selected item can be changed. Here, "resolution" is selected, where "fine" or "superfine" can be selected. Note that, in the first embodiment, "fine" refers to 600 dpi, and "superfine" refers to 1200 dpi. Here, an exemplary operation in which "fine" (600 dpi) is set will be described, but there is no limitation thereto.

In addition, when "halftone" is selected in the setting list 502 in FIG. 5, a pattern of a halftone processing method can be changed in accordance with an attribute signal ("Text", "Graphics", "Image", etc.) of an object generated from information written in PDL. Default setting is "pattern 2" as illustrated. In this "pattern 2", high screen ruling (about 200 lines) is assigned to "Text" attribute for which reproduction of details is important, and low screen ruling (about 150 lines) is assigned to "Graphics/Image" attribute for which stable reproduction of dots is important. By changing the setting of this pattern to those of another pattern, it is possible to change a combination of screen rulings that are assigned to attributes, uniformize screen rulings of all of the attributes, and assign error diffusion processing.

Figure 8:
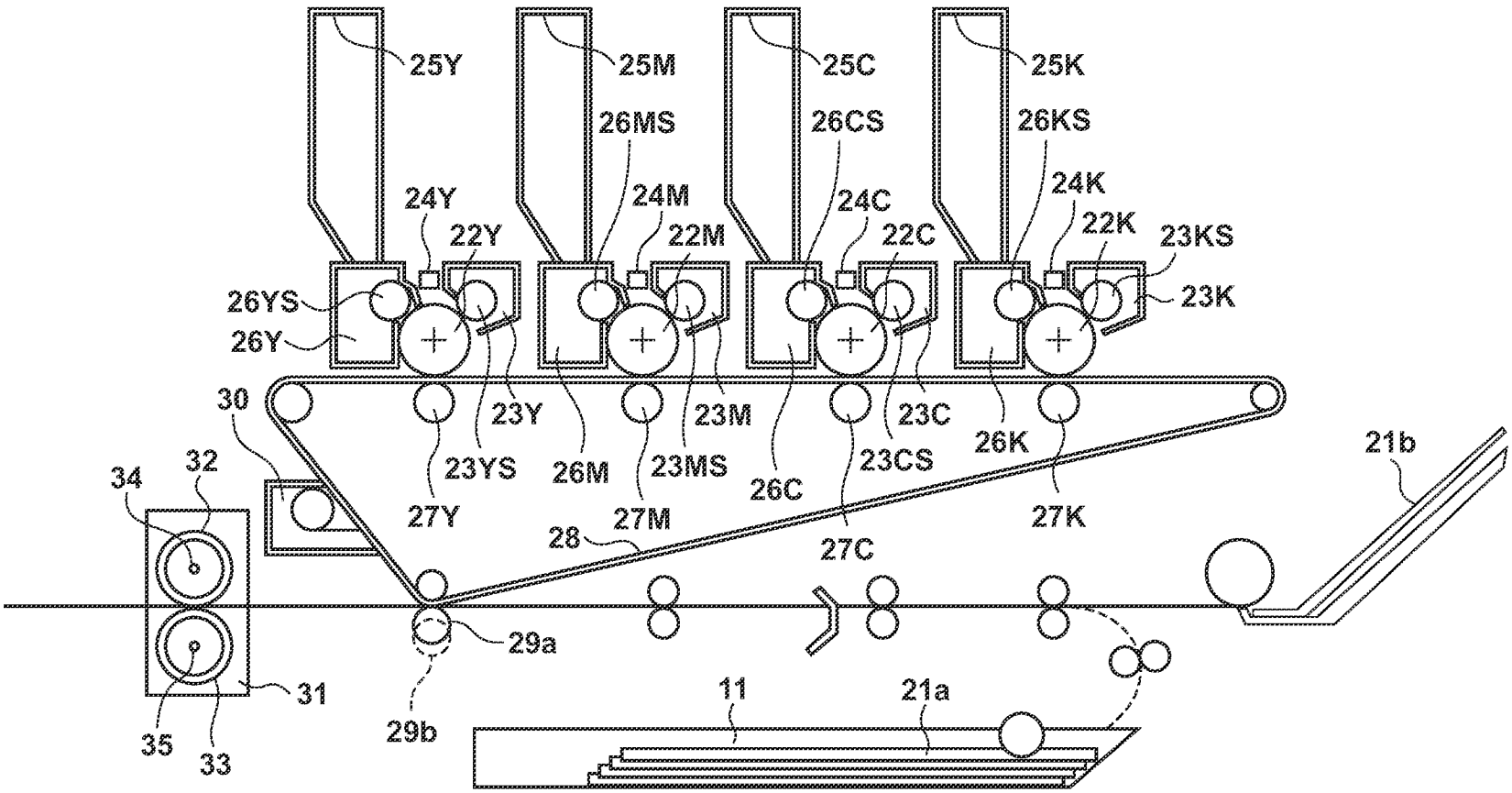
FIG. 8 depicts a cross-sectional view illustrating the configuration of a print unit of the image forming apparatus according to the first embodiment.

FIG. 8 depicts a cross-sectional view for describing the configuration of the print unit 206 of the image forming apparatus 101 according to the first embodiment. Here, the image forming apparatus 101 is a tandem-type electrophotographic image forming apparatus in which an intermediate transfer member 28 is adopted. Operations of the print unit 206 will be described below with reference to FIG. 8. Note that, in the drawings, members provided for each color is indicated by adding an alphabet (Y/M/C/K) indicating the color, after their reference numerals, but when description is given without distinguishing colors particularly, such alphabets after reference numerals are omitted.

The print unit 206 exposes photosensitive members 22 in accordance with image data processed by the image processing unit 207, and forms electrostatic latent images. The electrostatic latent images are then developed so as to form monochrome toner images. By overlaying the monochrome toner images on the intermediate transfer member 28, a multicolor toner image is formed. This multicolor toner image is transferred onto a recording medium 11, and the multicolor toner image on the recording medium is fixed by a fixing unit 31.

Next, the configuration of the print unit 206 will be described with reference to FIG. 8. An injection charger 23 is a charger for uniformly charging the surface of the photosensitive member 22 to a predetermined potential, and is provided with a sleeve 23S. The photosensitive member 22 rotates as a result of a driving force of a drive motor (not illustrated) being transmitted, and the drive motor rotates the photosensitive member 22 in the counter-clockwise direction in accordance with an image formation operation. An exposure device performs LED exposure from a line head 24 arranged in parallel with the photosensitive member 22, and forms an electrostatic latent image by selectively exposing the surface of the photosensitive member 22. Note that the print unit 206 in the first embodiment drives at a resolution of 1200 dpi in a direction parallel to the line head 24 (hereinafter, a main scanning direction) and 1200 dpi in a sub-scanning direction orthogonal to the main scanning direction. A developing device 26 is a device for visualizing an electrostatic latent image on the photosensitive member 22 using monochrome toner, and is provided with a sleeve 26S. Note that the developing device 26 can be attached/detached from the photosensitive member 22.

The intermediate transfer member 28 rotates in the clockwise direction in order to receive monochrome toner images from the photosensitive member 22, and the monochrome toner images are transferred as the photosensitive member 22 and a primary transfer roller 27 positioned opposite to the photosensitive member 22 rotate. By applying an appropriate bias voltage to the primary transfer roller 27, and making the rotation speed of the photosensitive member 22 different from the rotation speed of the intermediate transfer member 28, the monochrome toner images are efficiently transferred onto the intermediate transfer member 28. This is called primary transfer. Furthermore, the monochrome toner images respectively corresponding to the CMYK stations are overlaid on the intermediate transfer member 28. A multicolor toner image resulting from overlaying the monochrome toner images is conveyed to secondary transfer rollers 29 as the intermediate transfer member 28 rotates. At the same time, the recording medium 11 is conveyed from a paper feed tray 21, being sandwiched by the secondary transfer rollers 29, and the multicolor toner image on the intermediate transfer member 28 is transferred onto the recording medium 11. At this time, by applying an appropriate bias voltage to the secondary transfer rollers 29, the toner image is transferred electrostatically. This is called secondary transfer. When the multicolor toner image is being transferred onto the recording medium 11, the secondary transfer rollers 29 abut on the recording medium 11 at a position 29*a*, and, after the transfer, are separated at a position 29*b*.

The fixing unit 31 is provided with a fixing roller 32 that heats the recording medium 11 and a pressing roller 33 for pressing the recording medium 11 onto the fixing roller 32, in order to fuse the multicolor toner image transferred onto the recording medium 11 to the recording medium 11. The fixing roller 32 and the pressing roller 33 are formed in a hollow manner, and respectively have heaters 34 and 35 incorporated therein. The fixing unit 31 conveys the recording medium 11 that holds the multicolor toner image, using the fixing roller 32 and the pressing roller 33, applies heat and pressure, and fix toner to the recording medium 11. The recording medium 11 to which the toner has been fixed is then discharged to a paper discharge tray (not illustrated) using a discharge roller (not illustrated), and the image formation operation ends. A cleaning unit 30 is a unit for cleaning toner remaining on the intermediate transfer member 28, and waste toner that remains after the four-color toner image formed on the intermediate transfer member 28 has been transferred to the recording medium 11 is stored in a cleaner container.

Figure 9:
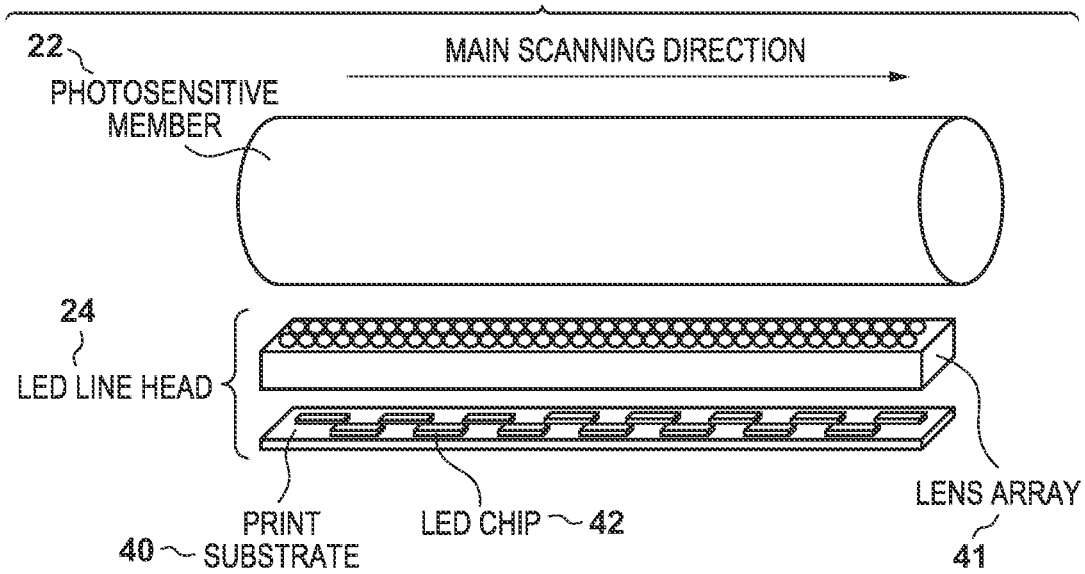
FIG. 9 is a diagram showing a configuration example of an LED line head arranged in parallel with a photosensitive member, in the print unit of the image forming apparatus according to the first embodiment.

FIG. 9 is a diagram showing a configuration example of the LED line head 24 arranged in parallel with the photosensitive member 22, in the print unit 206 of the image forming apparatus 101 according to the first embodiment.

In the first embodiment, the LED line head 24 has a print substrate 40 on which a circuit for supplying various signals for controlling driving of the LED line head 24 is formed, a lens array 41, and a plurality of the LED chips 42 arranged in a staggered manner. Note that the ROM 211 that stores light amount information of the LED line head measured in a manufacturing process, and the like is also arranged on the back side of the print substrate 40, or the like.

Figure 10:
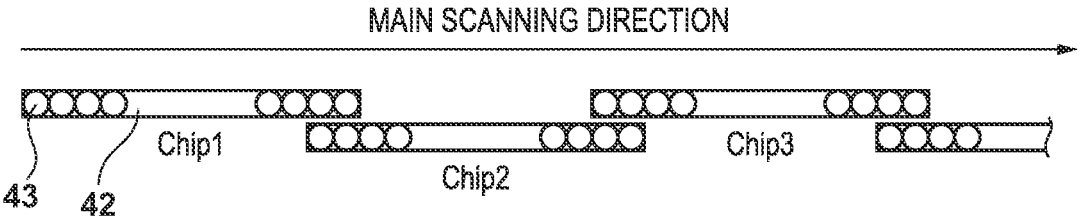
FIG. 10 is a diagram showing an arrangement example of LED chips of an LED line head and light emitting devices in the LED chips according to the first embodiment.

The LED chips 42 are configured to have a large number of (e.g., 512) LED light emitting devices 43 having the same size and arranged in a line at equal intervals as shown in FIG. 10. Note that the LED chips 42 are disposed in a staggered arrangement in which two light emitting devices 43 in main scanning edge portions of each of the LED chips 42 overlap. In addition, in the first embodiment, SLED (self-scanning LED) array chips are used as the LED chips 42, but there is no limitation thereto.

The lens array 41 is arranged as image forming lenses between the LED chips 42 and the photosensitive member 22. In the lens array 41, LED gradient-index or refractive index distributed type rod lenses are, for example, arranged with a pitch corresponding to pixels that are based on the resolution, and form an image from light beams emitted from the LED light emitting devices 43 onto the photosensitive member 22. In this manner, the LED line head 24 has a configuration in which a large number of light emitting devices 43 are arranged in the main scanning direction, and there are individual differences in light amount among light emitting devices at respective main scanning positions.

Figure 11:
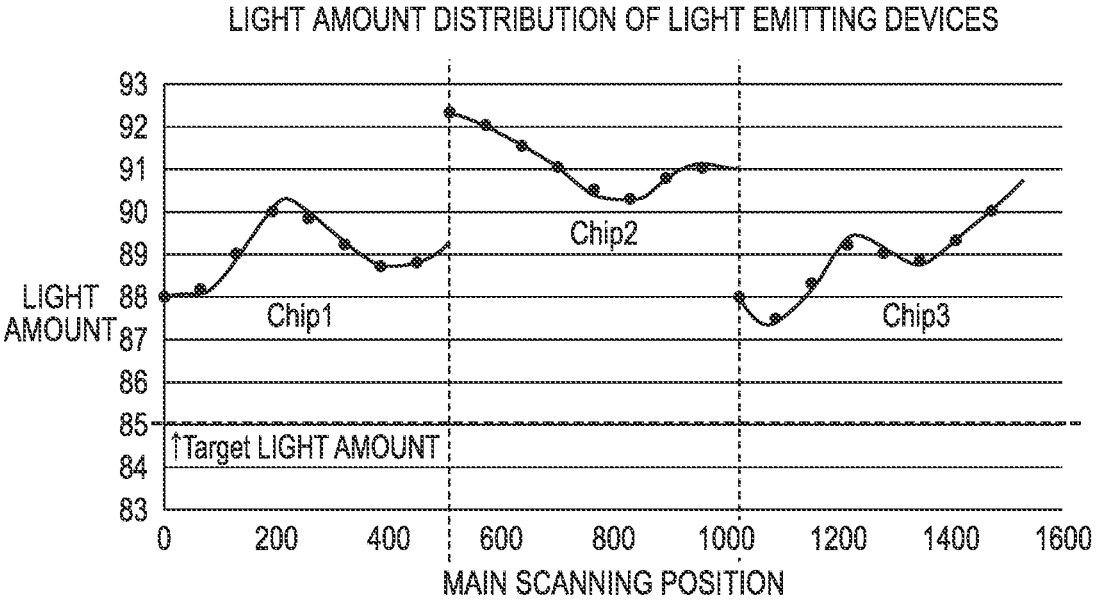
FIG. 11 is a diagram showing an example of differences in light amounts of light emitting devices, in contrast to a target light amount of the light emitting devices of LED chips of the LED line head according to the first embodiment.

FIG. 11 is a diagram showing an example of light amount differences of light emitting devices, in contrast to target light amounts of light emitting devices of LED chips of each LED line head according to a working example.

A plurality of LED chips arranged on the print substrate 40 are not correlated, and thus discontinuous light amount differences are exhibited. Note that FIG. 11 shows a graph of light amounts at respective main scanning positions when light emitting devices in main scanning edge portions of each LED chip do not overlap, for ease of description.

In the example in FIG. 11, the light amounts of the light emitting devices of all of the chips are larger than the target light amounts.

Next, the configuration of the image processing unit 207 that performs image processing on image data included in printing data that has been input, when the image forming apparatus 101 according to the first embodiment causes the print unit 206 to form (print) an image will be described.

Figure 3:
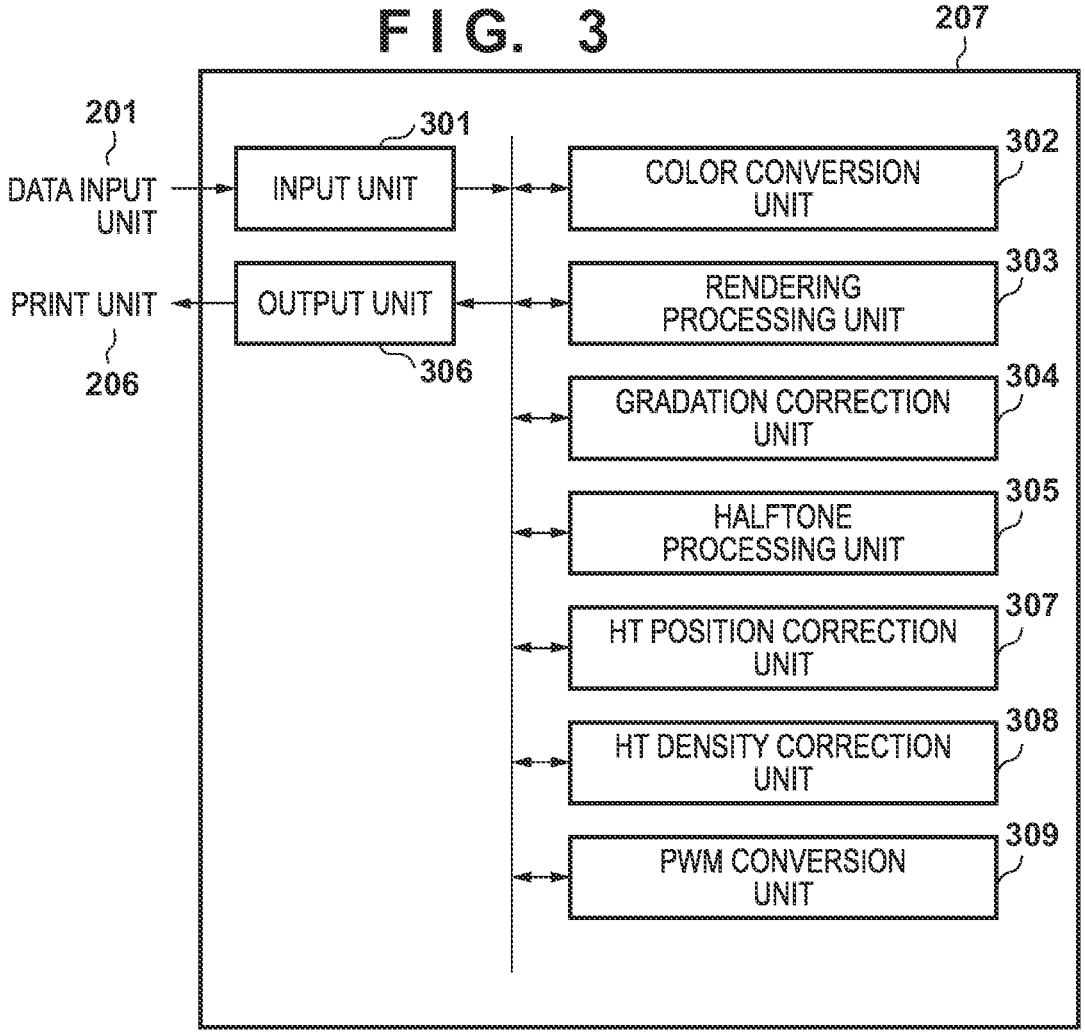
FIG. 3 is a functional block diagram for describing functions of an image processing unit of the image forming apparatus according to the first embodiment.

FIG. 3 is a functional block diagram for describing functions of the image processing unit 207 of the image forming apparatus 101 according to the first embodiment. Note that, as described above, such functions of the image processing unit 207 may be realized by hardware, or may also be realized by the CPU 208 executing programs.

The image processing unit 207 includes an input unit 301, a color conversion unit 302, a rendering processing unit 303, a gradation correction unit 304, a halftone (HT) processing unit 305, an output unit 306, an HT position correction unit 307, an HT density correction unit 308, and a PWM conversion unit 309. Note that the prefix "HT" of the HT position correction unit 307 and the HT density correction unit 308 is abbreviation for "halftone", and indicates that image data that underwent halftone processing is received and processed by those units.

The input unit 301 receives, for example, image data that is included in printing data received by the data input unit 201, and is written in PDL (page descriptive language). The color conversion unit 302 performs color conversion from RGB into CMYK, for example. The rendering processing unit 303 performs rendering of PDL data, and converts the data into image data. Note that the rendering processing unit 303 can switch rendering processing in accordance with an instruction of "fine" for generating image data at a resolution of 600 dpi in the main scanning direction and the sub-scanning direction, or "superfine" for generating image data at a resolution of 1200 dpi in the main scanning direction and the sub-scanning direction. Such resolution setting can be made from the function setting screen described above and shown in FIG. 5, and a resolution is selected in accordance with an instruction of resolution included in the printing data received by the data input unit 201.

The gradation correction unit 304 performs gradation correction on image data of CMYK color planes to be subjected to halftone processing that is applied to halftone of image data, in accordance with the density property of the print unit 206, so as to achieve aimed output density. Note that the density property of the print unit 206 mentioned herein is obtained by printing a halftone dot patch achieved by performing halftone processing on signal values of the color planes in a state where density unevenness and streaks due to light amount differences of the LED line heads 24 have been corrected by the HT density correction unit 308, and performing measurement in the printed article.

The halftone processing unit 305 performs halftone processing on the image data of CMYK color planes that underwent gradation correction, and converts the image data into a halftone dot image pattern that expresses the halftone of the image data as area gradation, and has been converted into N values. Note that, in the first embodiment, conversion into a resolution of 1200 dpi that is the same as the print resolution is carried out at the same time. Specifically, in order to perform halftone processing appropriate for the print resolution of 1200 dpi, on image data that has a resolution of 600 dpi and has been input, halftone processing is performed while repeatedly referencing the input image data having the resolution of 600 dpi twice both in the main scanning direction and the sub-scanning direction.

However, as a characteristic of the first embodiment, the resolution of image data does not necessarily need to match the print resolution at the stage of halftone processing, and it suffices for the resolution of image data to be higher than or equal to the print resolution as a result of the image data being processed by the HT position correction unit 307 to be described later or the HT density correction unit 308.

The HT position correction unit 307 performs position correction processing on halftone dot image data that has been generated by the halftone processing unit 305 and has undergone halftone processing. Specifically, in order to shift the writing position in the print unit 206, the position of image data is offset in the main scanning direction and sub-scanning direction. For example, when the printing position is desired to be shifted by 20 μm in the main scanning direction, if the resolution of the image is 1200 dpi, the entire image data is shifted by one pixel in the main scanning direction. In addition, in order to correct the printing magnification of image data, pixels are inserted/extracted in accordance with the printing magnification. For example, if the printing magnification in the main scanning direction is desired to be increased by 1%, the image can be enlarged by inserting the same pixel as a pixel at a reference position once for 100 pixels. In contrast, if the printing magnification is desired to be decreased by 1%, the image can be reduced by extracting a pixel at a reference position once in 100 pixels, and closing up the remaining pixels in the image data. Besides, the HT position correction unit 307 may perform processing such as correction of inclination of a line head and correction of inclination of an LED chip.

Note that, here, it is important that the HT position correction unit 307, which performs correction processing before the HT density correction unit 308, performs at least position correction for main scanning positions. This is because the light emitting devices of the line heads and the positions in the image data need to correspond to each other in order to allow the HT density correction unit 308, which is a feature of the first embodiment, to correct density unevenness and streaks caused by light amount differences of the light emitting devices in the line heads.

Note that, position correction of the HT position correction unit 307 is required in the following situations, for example.

As described above, a tandem type color printer includes line heads for respective CMYK color planes, and performs image formation by overlaying images of the respective colors, but it is difficult to accurately align assembly positions of the line heads. Therefore, it is necessary to correct a writing position in the main scanning direction for each of the color planes.

In double-sided printing, when, for example, paper passes such that the front side of the paper is on the fixing roller 32 side, the paper thermally expands/shrinks. If printing is performed on the back side of the paper in that state, difference in printing position and printing magnification is caused between the front side and the back side. Thus, in order to uniformize the positions and magnifications on the front side and back side of paper, position correction in which expansion/shrink due to fixing is taken into consideration is required.

In a line head, during printing, the print substrate on which the LED chips are arranged expands/shrinks due to heat generated by using a large number of light sources, and the like. Therefore, it is necessary to correct the writing position and printing magnification in order to prevent the printing position from changing due to expansion/shrink of the print substrate.

Moreover, in the first embodiment, the HT position correction unit 307 performs position correction on image data that underwent halftone processing. Accordingly, even if position correction is carried out at a high resolution in order to increase the accuracy of position correction, the number of bits per pixel is small, and thus it is possible to suppress the capacity of the memory for recording the image data. In addition, position correction is performed on halftone image data, and thus inverse correction for the above-described change in printing magnification during printing can be performed on a halftone dot pattern. Therefore, unlike a case where position correction of image data before being subjected to halftone processing is performed, it is possible to suppress a change in the halftone dot interval of the halftone dot pattern, and to prevent occurrence of moiré between colors.

The HT density correction unit 308 obtains, from the ROM 211 provided in a line head of each color plane of the print unit 206, information regarding light amounts measured during manufacturing of the line head. The HT density correction unit 308 then performs density correction that is based on the information regarding the light amounts on halftone dot image data that has undergone position correction performed by the HT position correction unit 307 and halftone processing, for each position in the main scanning direction. Note that the HT density correction unit 308 that is a feature of the first embodiment will be described later in detail.

A PWM (pulse width modulation) conversion unit 309 converts image data for the color planes that is output from the HT density correction unit 308 into PWM signals indicating a time of exposure to be performed by the LED line heads 24 of the print unit 206. In the print unit 206, the photosensitive member 22 is exposed and a latent image is formed in accordance with the PWM signals corresponding to the image data. Note that, in the first embodiment, the number of divisions of the exposure time of the PWM is set to 7 (3 bits), but the present invention is not limited thereto. The output unit 306 the passes the PWM signals generated by the PWM conversion unit 309 to the print unit 206.

Next, a flow of image processing that is performed by the image processing unit 207 described with reference to FIG. 3 will be described.

Figure 4:
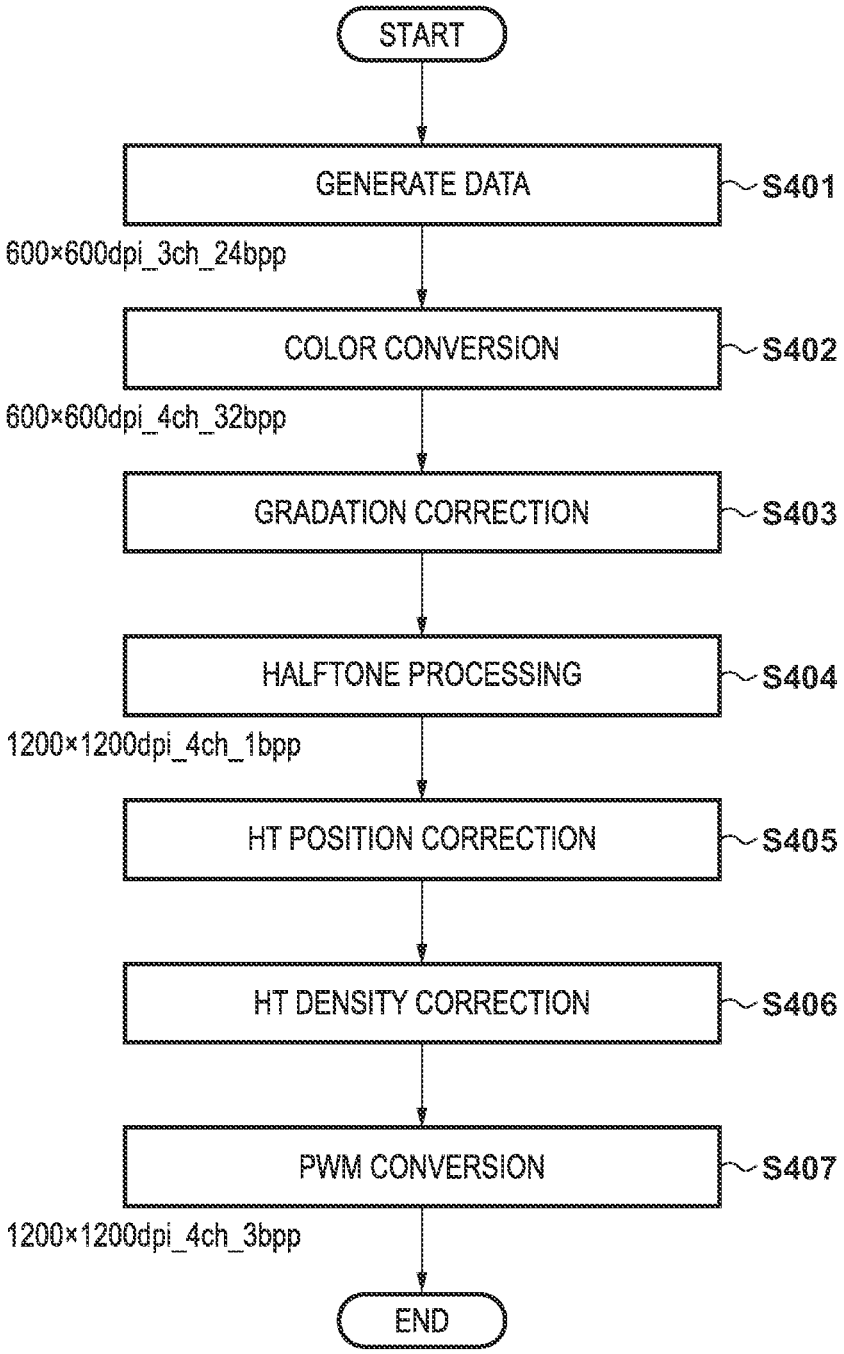
FIG. 4 is a flowchart for describing image processing that is performed by the image processing unit according to the first embodiment.

FIG. 4 is a flowchart for describing image processing that is performed by the image processing unit 207 according to the first embodiment. Here, this processing is achieved by the CPU 208 deploying a program stored in the storage unit 204 to the RAM 210, and executing the program.

First, in step S401, the CPU 208 passes document data that has been received by the data input unit 201 and is to be printed out, to the rendering processing unit 303 via the input unit 301 of the image processing unit 207. The document data that has been input is then converted into RGB raster image data by the rendering processing unit 303 at a resolution of 600 dpi both in the main scanning direction and sub-scanning direction, and the image data is supplied to the color conversion unit 302. Next, the procedure advances to step S402, where the CPU 208 performs color conversion on RGB data generated by the color conversion unit 302 into CMYK data, and passes the CMYK data to the gradation correction unit 304. In FIG. 4, "600×600 dpi_3ch_24bpp" indicates 24-bit RGB data whose resolution is 600 dpi, and "600×600 dpi_4ch_32bpp" indicates 32-bit CMYK data whose resolution is 600 dpi.

Next, the procedure advances to step S403, where the CPU 208 controls the gradation correction unit 304 so as to perform gradation correction processing on image data of the color planes, in which the gradation characteristics of the print unit 206 of the image forming apparatus 101 for a halftone processing pattern to be applied to the halftone of the image data is taken into consideration, and passes the processed image data to the halftone processing unit 305. Note that the gradation characteristics of the print unit 206 changes in accordance with a halftone processing method, and thus it is necessary to switch gradation correction processing based on a halftone processing method. In view of this, gradation correction processing is performed in accordance with halftone setting in the setting list 502 in FIG. 5.

Next, the procedure advances to step S404, where the CPU 208 controls the halftone processing unit 305 so as to perform halftone processing at 1200 dpi_1 bit output while performing, on the CMYK data that has undergone gradation correction, resolution conversion from a resolution of 600 dpi to the print resolution of 1200 dpi. In this manner, a halftone image for area gradation expression is generated. The halftone image is then passed to the HT position correction unit 307. In FIG. 4, "1200×1200 dpi_4ch_1bpp" indicates 1-bit CMYK data whose resolution is 1200 dpi.

Next, the procedure advances to step S405, where the CPU 208 controls the HT position correction unit 307 so as to perform position correction on the halftone image data, and passes the processed image data to the HT density correction unit 308. Next, the procedure advances to step S406, where the CPU 208 controls the HT density correction unit 308, which is a feature of the first embodiment, so as to obtain information regarding the light amounts from the ROM 211 held in the LED line head 24 of each of the CMYK colors, performs density correction processing on the halftone image data for each main scanning position based on the information regarding the light amounts, and passes the processed data to the PWM conversion unit 309. Next, the procedure advances to step S407, where the CPU 208 controls the PWM conversion unit 309 so as to convert the received 1-bit image data having a resolution of 1200 dpi into PWM signal data indicating a time of exposure of the photosensitive member 22 by the LED light emitting devices 43, and passes the PWM signal data to the output unit 306.

Next, processing of the HT density correction unit 308, which is a feature of the first embodiment, will be described.

Figure 6:
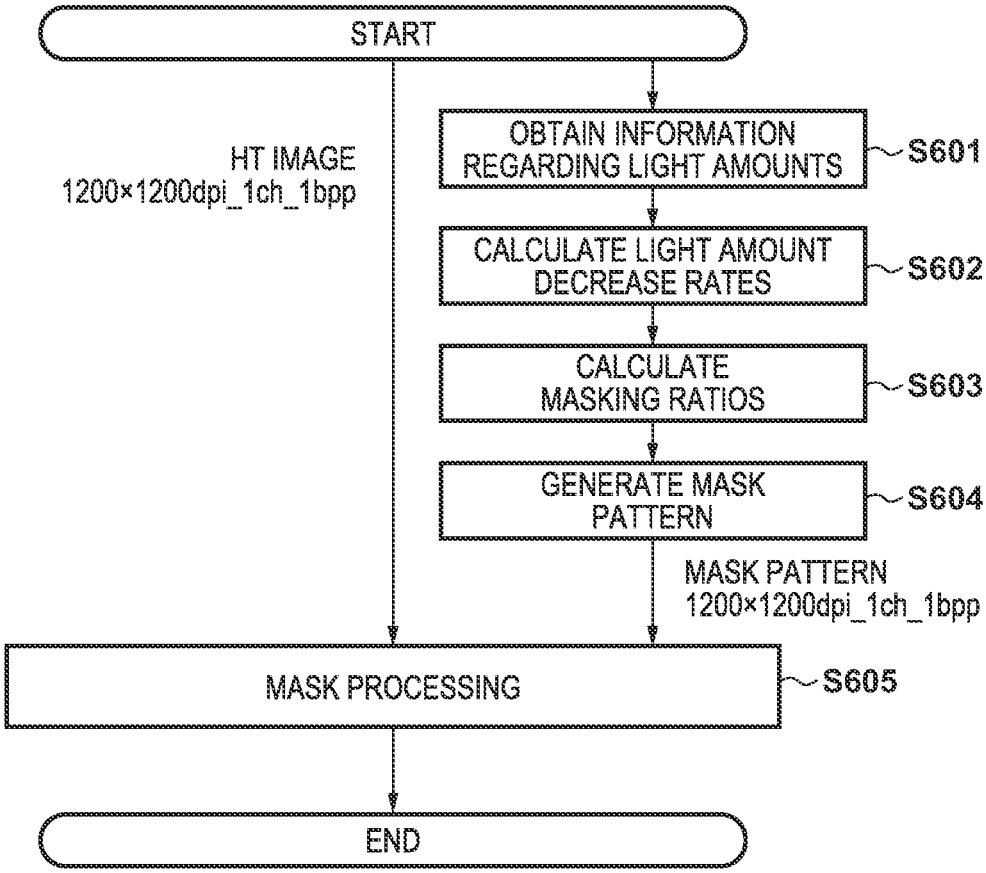
FIG. 6 is a flowchart for describing image processing that is performed by an HT density correction unit according to the first embodiment.

FIG. 6 is a flowchart for describing image processing that is performed by the HT density correction unit 308 according to the first embodiment. Note that this processing is achieved by the CPU 208 deploying a program stored in the storage unit 204 to the RAM 210, and executing the program.

First, in step S601, the CPU 208 controls the HT density correction unit 308 so as to obtain information regarding light amounts from the ROM 211 held in the LED line head 24 of each of the CMYK colors. Next, the procedure advances to step S602, where the CPU 208 controls the HT density correction unit 308 so as to calculate light amounts % by which the light amounts are to be reduced at respective main scanning positions in order to reach a target light amount.

For example, in the example in FIG. 11, an example of a target light amount and light amount distribution of light emitting devices is illustrated in a graph, and FIG. 12 shows light amount decrease rates required to achieve the target light amount at the main scanning positions.

Figure 7:
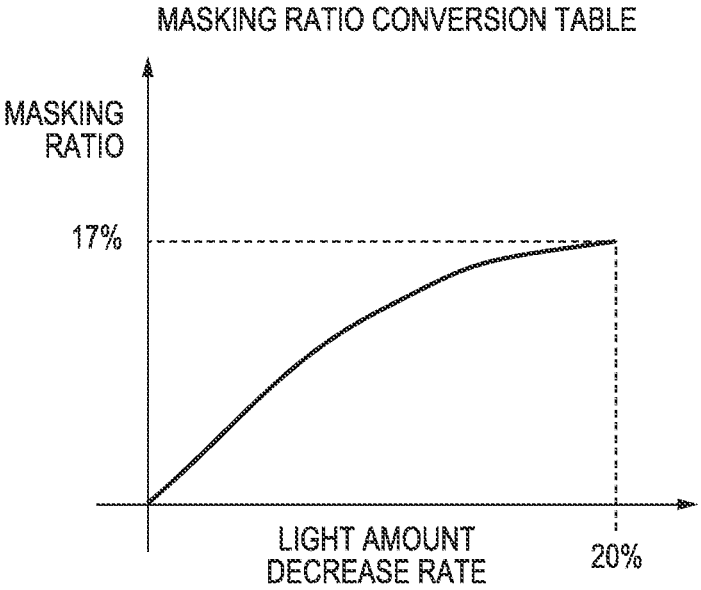
FIG. 7 is a diagram showing an example of a table for obtaining masking ratios from light amount decrease rates according to the first embodiment.

Next, the procedure advances to step S603, where the CPU 208 controls the HT density correction unit 308 so as to obtain masking ratios that are in accordance with the light amount decrease rates, using the masking ratio conversion table as shown in FIG. 7.

FIG. 7 is a diagram showing an example of the table for obtaining masking ratios in accordance with light amount decrease rates according to the first embodiment.

The way of density change is not the same in a case where the light amounts are actually controlled and a case where mask processing is performed on image data. In view of this, in intermediate-high density regions in which density unevenness due to light amount difference is likely to be conspicuous, a masking ratio that causes a density change that is substantially the same as a density change when the light amount is actually reduced is obtained in advance through actual measurement, and a table for conversion into this masking ratio is generated. Note that, the way the density is affected differs depending on an image formation method as well, and thus the content of this conversion table may be switched in accordance with halftone setting in the setting list 502 in FIG. 5.

Only masking processing with a masking ratio that is the same as the light amount decrease rate leads to suppression of density unevenness due to light amount differences, and thus, for ease of description, description will be given below assuming that a masking ratio has a linear relationship with a light amount decrease rate, for example, a masking ratio when it is desired to decrease the light amount by 1% is 1%, and a masking ratio when it is desired to decrease the light amount by 2% is 2%.

Next, the procedure advances to step S604, where the CPU 208 controls the HT density correction unit 308 so as to generate a mask pattern corresponding to the masking ratios obtained for the respective main scanning positions. Specifically, the mask pattern is generated by performing halftone processing by a dither method using the masking ratios and a threshold matrix for generating a mask pattern shown in FIG. 13A. In other words, here, processing equivalent to halftone processing that is performed by the halftone processing unit 305 is carried out.

Figures 13A, 13B:
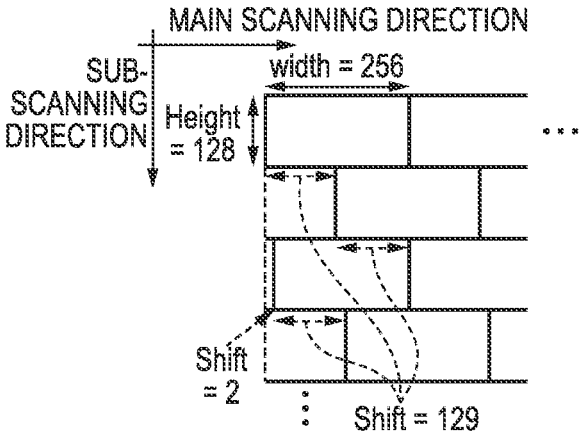

In the first embodiment, the light amount decrease rates (=masking ratios) are controlled by 0.1% step, and thus thresholds in the threshold matrix are 10-bit. Thus, by comparing light amount decrease signals obtained by normalizing the light amount decrease rates (=masking ratios) in FIG. 12 to 10 bits with the thresholds in the threshold matrix, a mask pattern of binary values is generated. At this time, the light amount decrease signals are determined for main scanning positions irrespective of sub scanning positions, and the thresholds in the threshold matrix change in accordance with a sub scanning position, and thereby the light amount decrease rates (=masking ratios) and mask positions are controlled. Note that the threshold matrix has a main scanning width (256) and a sub scanning height (128) as shown in FIG. 13A. When only mask amounts in the sub-scanning direction are controlled in accordance with light amount decrease rates (=masking ratios) at main scanning positions, the main scanning width may be "1". However, in that case, if the same light amount decrease rate (=masking ratio) continues in the main scanning direction, masking processing is performed at the same sub scanning position, and a mask pattern of a horizontal line is obtained. It is necessary to change the thinning position in the sub-scanning direction in accordance with the main scanning position, and thus the threshold matrix has a width in the main scanning direction.

In addition, as shown in FIG. 13B, the thresholds in the threshold matrix are arranged in the vertical direction and horizontal direction, and are repeatedly referenced. At this time, when the threshold matrix is referenced in the vertical direction, the arrangement is shifted by a predetermined shift amount (here, 129) in the main scanning direction, and the threshold matrix is referenced. Accordingly, for example, in the threshold matrix in which thresholds are randomly arranged as shown in FIG. 13A, even if the table is small, frequency characteristic of a masking cycle (sub-scanning direction) of the threshold matrix can be scattered.

FIG. 13C is a diagram showing an example of light amount decrease rates (=masking ratios) at main scanning positions and a threshold matrix.

For example, if the light amount decrease rate at a main scanning position of 0 is 3%, and is normalized to 10-bit, a light amount decrease signal is at level 31. This light amount decrease signal is compared with a threshold by referencing the threshold matrix in accordance with a sub scanning position. A mask pattern is generated in which, if a light amount decrease signal is larger than a threshold, 1 (masking processing is performed) is set, and if a light amount decrease signal is smaller than a threshold, 0 (masking processing is not performed) is set. At this time, for example, when the number of pixels in a repetition cycle of thresholds in the sub-scanning direction of the threshold matrix is 1000 pixels, light amount decrease rates (=masking ratios) at main scanning positions are controlled by setting thresholds (smaller than level 31) for performing masking processing in 30 pixels out of the 1000 pixels.

Note that, an actual repetition cycle of thresholds in the sub-scanning direction can be obtained from (the least common multiple of the main scanning width of the threshold matrix and the shift amount)×(the sub scanning height of the threshold matrix), but the actual repetition cycle is not limited thereto.

Next, the procedure advances to step S605, where the CPU 208 controls the HT density correction unit 308 so as to carry out mask processing of a halftone image received from the HT position correction unit 307, using the generated mask pattern. The image data that has undergone density correction through mask processing is then passed to the PWM conversion unit 309.

Specifically, by reversing the mask pattern, and obtaining a logical product of the mask pattern and the halftone image data, mask processing of the halftone image is performed, and density correction at main scanning positions is realized. Accordingly, it is possible to suppress density unevenness and streaks due to light amount differences of the LED line heads 24.

Figure 14A:
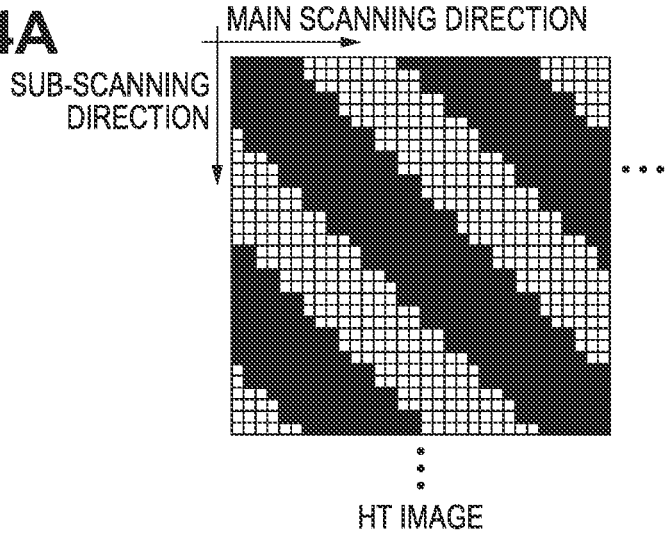
FIGS. 14A to 14C are diagrams showing an example of mask processing in the first embodiment.
Figure 14B:
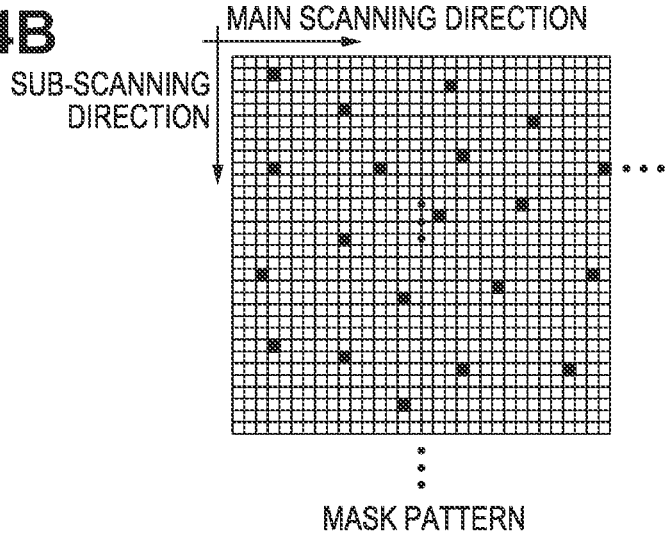
Figure 14C:
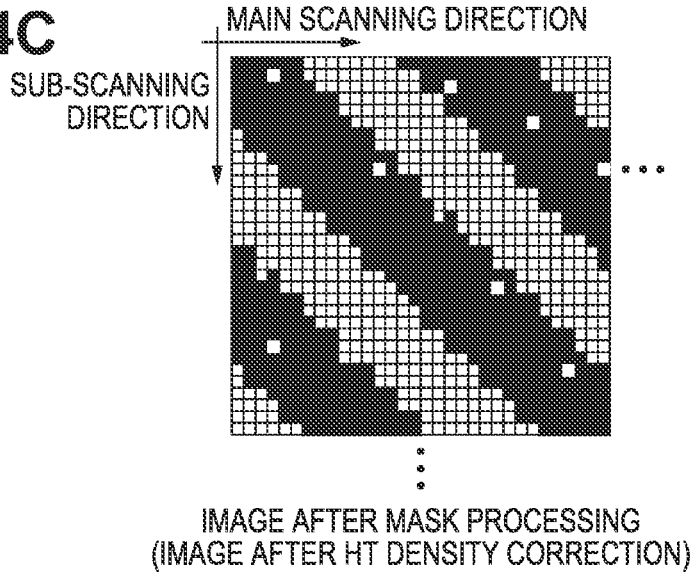

FIGS. 14A to 14C are diagrams showing an example of mask processing in the first embodiment.

FIG. 14A shows a portion of halftone image data received from the HT position correction processing unit 307, and FIG. 14B shows a mask pattern generated from masking ratios at positions corresponding to halftone image data. FIG. 14C shows image data that has undergone mask processing in which a logical product of the halftone image data in FIG. 14A and the inverted mask image in FIG. 14B is obtained.

Note that the threshold matrix for a mask pattern used in the first embodiment is a threshold matrix that has a blue noise property in order to suppress intense moiré caused by interference of the halftone image and the mask pattern, but the present invention is not limited thereto.

In addition, the threshold matrix for a mask pattern shown in FIG. 13A has a size with a width and height of 256×128, and is used while being shifted by 129 in the main scanning direction, but the present invention is not limited thereto.

Note that, in order to suppress light amount differences of light emitting devices at main scanning positions, it is desired to accurately control masking ratios for the respective main scanning positions, and therefore, it is desirable that occurrence frequency of each of the thresholds at the main scanning positions is uniform. Here, at least within the range of no more than approximately 0.1 mm in which the sensitivity of an eye is low in the main scanning direction, occurrence frequency of thresholds is uniformized. In view of this, it is set such that the threshold matrix width and the shift amount of the matrix are mutually prime. Accordingly, it is possible to uniformize the occurrence frequency of the thresholds at the main scanning positions.

In addition, in the first embodiment, a threshold matrix for a mask pattern that has 10-bit thresholds is used, but the maxim light amount difference is about 20%, and a necessary light amount decrease rate (=masking ratio) is approximately 20% at a maximum. Thus, for example, if 1023 is set for a masking ratio of 100%, it suffices for the thresholds to be at a level of up to 1023×0.2≈205, and it is possible to suppress the table size to be smaller by performing clip processing on the thresholds in the threshold matrix at 8 bits.

Note that, in the first embodiment, a mask pattern is generated by comparison with the threshold matrix, but the present invention is not limited thereto. For example, error diffusion processing may be carried out on masking ratio signals, or control may be performed such that masking occurs at random positions the number of times corresponding to the masking ratio, using a random number generator.

In addition, in the first embodiment, the ROM 211 stores information regarding the light amounts, but may also store the values of the differences from the target light amount calculated in step S602, the light amount decrease rates obtained from the difference, the masking ratios calculated in step S603, and the like. In addition, values that are determined based on the information regarding the light amounts may be stored, and there is no limitation to the information regarding the light amounts.

As described above, according to the first embodiment, mask processing is performed on halftone image data that is in positional correspondence with the light emitting devices, based on information regarding the light amounts of light emitting devices of an LED line head, and density correction is performed. Accordingly, it is possible to prevent occurrence of contrasting density (streaks and unevenness) due to light amount differences of pixels.

In this manner, if density correction that is based on information regarding the light amounts is performed on halftone image data, the scale of the circuit can be made small compared with density correction that is performed on multi-value image data, including position correction processing. In addition, density correction can be performed using a single threshold matrix for generating a mask pattern, and thus it is possible to reduce the scale of the circuit compared with a case where multi-value density correction tables are provided for respective main scanning positions. In addition, position connection can be carried out after halftone processing, and thus there is an effect that it is possible to suppress moiré between colors that occurs due to a change in a halftone dot pattern caused by magnification change (distortion) during printing.

Second Embodiment

In the above first embodiment, density correction is performed by performing masking processing on a halftone image that is in positional correspondence with light emitting devices, at masking ratios that are based on information regarding the light amounts of the light emitting devices of a LED line head.

In contrast, in a second embodiment, mask processing that is based on information regarding the light amounts of LED line heads described in the first embodiment is performed on image data whose resolution is increased to be higher than the print resolution of the print unit. An example will be described in which pseudo resolution conversion processing for returning the resolution to the same as the print resolution is then performed on the image data that has undergone mask processing, and the image data is printed.

In the second embodiment, mask processing is performed at a resolution higher than the print resolution that is based on the positions of the light emitting devices, and thereby mask processing can be performed using a mask pattern of a smaller size, and mask positions can be scattered. Accordingly, it is possible to perform density correction that is based on information regarding the light amounts of LED line heads without impairing the halftone dot structure of halftone image data in a large amount due to mask processing. Note that a configuration will be described in which the print unit 206 according to the second embodiment has a print resolution of a main scan resolution of 1200 dpi and a sub scan resolution of 2400 dpi, and a light emission timing of a light emitting device can be finely divided through PWM control, but the present invention is not limited thereto.

The second embodiment is different from the above first embodiment only in the configuration of a portion of the image processing unit 207 and operations in the HT density correction unit 308. Thus, the same reference numerals are assigned to portions similar to those in the above first embodiment, and a description thereof is omitted, and only different portions will be described below.

Next, the configuration of the image processing unit 207 that performs image processing on image data included in printing data that has been input, when the image forming apparatus 101 according to the second embodiment uses the print unit 206 to form (print) an image will be described.

Figure 15:
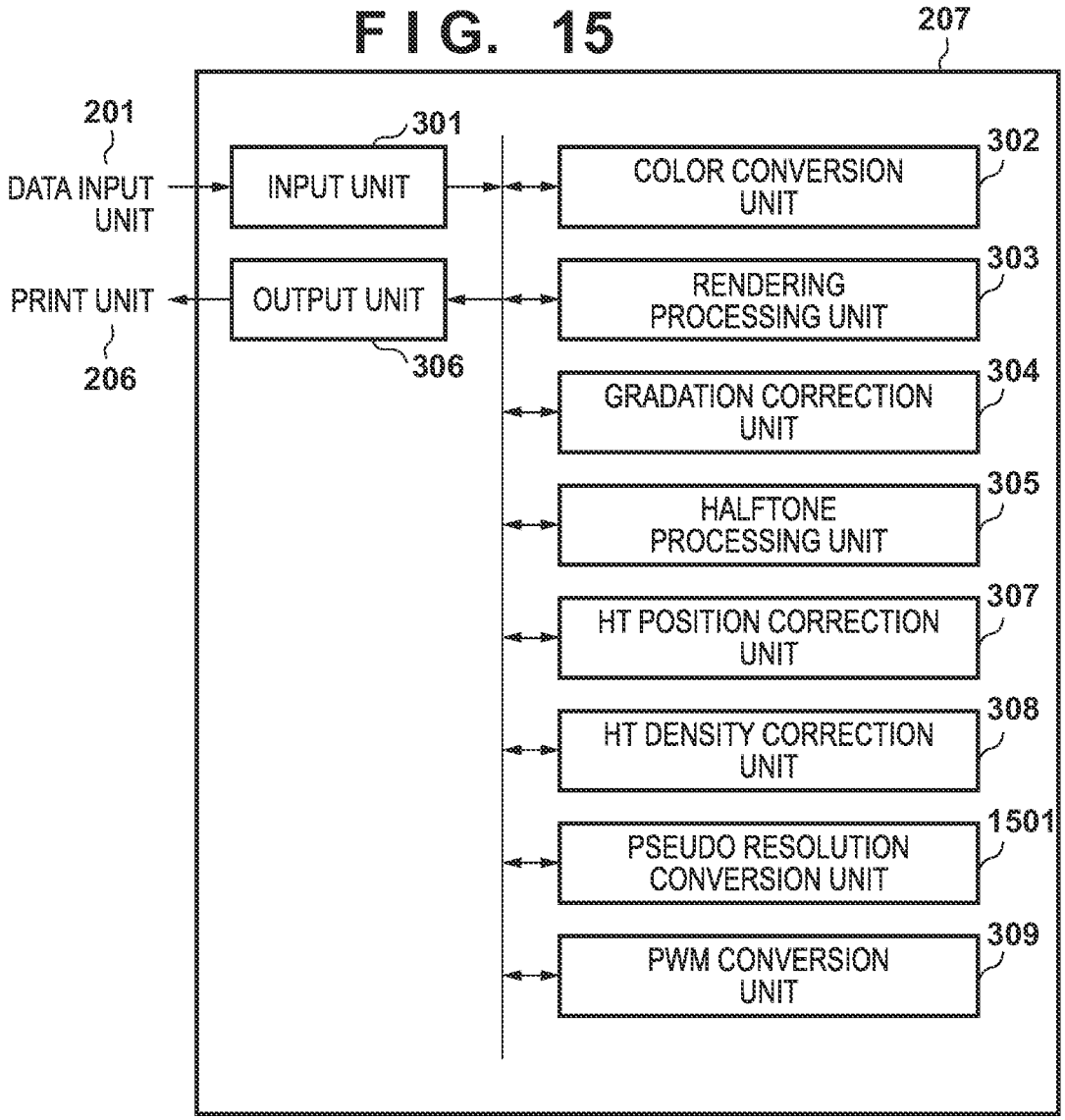
FIG. 15 is a block diagram for describing the functional configuration of an image processing unit of an image forming apparatus according to a second embodiment.

FIG. 15 is a block diagram for describing the functional configuration of the image processing unit 207 of the image forming apparatus 101 according to the second embodiment. Note that, as described above, functions of this image processing unit 207 may be realized by hardware, or may also be realized by the CPU 208 executing programs. This image processing unit 207 has a configuration in which a pseudo resolution conversion unit 1501 according to the second embodiment is added to the configuration of the first embodiment.

The HT density correction unit 308 obtains, from the ROM 211 included in the line head of each of the color planes of the print unit 206, information regarding the light amounts of light emitting devices measured during manufacturing of the line head. The HT position correction unit 307 performs density correction that is based on the information regarding the light amounts, on halftone dot image data that has undergone position correction and halftone processing, for each main scanning position. The second embodiment is characterized in that, at this time, HT density correction processing is performed on input image data having a main scanning resolution and a sub scanning resolution of 1200 dpi, at a resolution of 2400 dpi, which is higher than the print resolution. Here, HT density correction processing is performed while doubling the input image data of 1200 dpi in both the main scanning direction and the sub-scanning direction. Note that the resolution of image data during the HT density correction processing is not limited thereto, and it suffices for the resolution in one of the main scanning direction and the sub-scanning direction to be higher than the print resolution. In addition, in the second embodiment, regarding a timing for conversion into a higher resolution, the conversion is also performed in the HT density correction processing, but there is no limitation thereto, and the conversion may also be carried out in processing that is performed by an upstream unit such as the halftone processing unit 305.

The pseudo resolution conversion unit 1501 performs pseudo resolution conversion processing on halftone image data that has undergone density correction, has been received from the HT density correction unit 308, and has a resolution of 2400 dpi in the main scanning direction and the sub-scanning direction. The processed image data is then converted into image data whose resolution in the main scanning direction is 1200 dpi and whose resolution in the sub-scanning direction is 2400 dpi, which is the same as the print resolution at which the print unit 206 can perform printing. This pseudo resolution conversion processing will be described later in detail.

The PWM conversion unit 309 converts image data of respective color planes that is output from the pseudo resolution conversion unit 1501, into PWM signal data indicating a time of exposure that is performed by the LED line heads 24 of the print unit 206.

Next, operations of the pseudo resolution conversion unit 1501 according to the second embodiment will be described in detail with reference to FIG. 17A to 17D.

FIG. 17A to 17D are diagrams schematically showing resolution conversion processing that is performed by the pseudo resolution conversion unit 1501 according to the second embodiment. In the second embodiment, the pseudo resolution conversion unit 1501 converts image data having a resolution of 2400 dpi in the main scanning and the sub-scanning direction, into image data of 1200 dpi in the main scanning direction and 2400 dpi in the sub-scanning direction (printing resolution), but the present invention is not limited thereto.

Figure 17A:
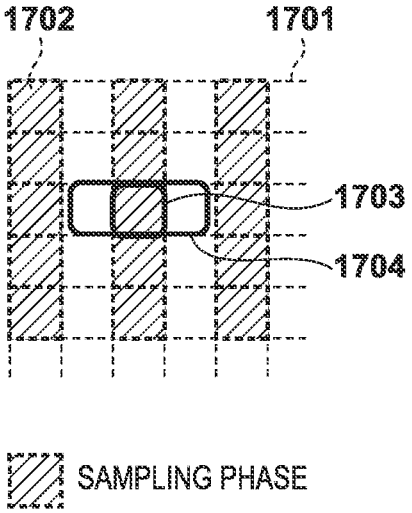
FIGS. 17A to 17D are diagrams schematically showing resolution conversion processing that is performed by a pseudo resolution conversion unit according to the second embodiment.

FIG. 17A is a diagram showing the relationship between image data and a processing rectangle in pseudo resolution conversion processing. FIG. 17A shows a view illustrating the relationship between image data 1701 with a resolution of 2400 dpi that is input to the pseudo resolution conversion unit 1501 and a processing rectangle 1704 composed of three pixels and centered on a pixel of interest (pixel to be processed) 1703. Pseudo resolution conversion processing is performed by performing resampling while moving the processing rectangle 1704, and performing a product-sum operation (see FIGS. 17B, 17C, and 17D) within the region of the processing rectangle 1704.

Pseudo resolution conversion processing according to the second embodiment is processing for converting the resolution of image data that has been input, from a resolution of 2400 dpi in the main scanning and the sub-scanning direction into a resolution of 1200 dpi in the main scanning direction and 2400 dpi in the sub-scanning direction.

Therefore, the processing rectangle 1704 is used to perform processing on the image data 1701 having a resolution of 2400 dpi, while sequentially moving the pixel of interest 1703 on resampling positions 1702 (positions indicated by oblique lines in FIG. 17A) located every other pixel in the main scanning direction. A resampling position is a position of a pixel to be processed when performing pseudo resolution conversion processing, and, in the second embodiment, is arranged in the main scanning direction at the interval of every other pixel. Arrangement interval of this resampling position 1702 is called "resampling interval". This resampling interval is determined in accordance with the reduction rates of the resolution in the main scanning direction and the resolution in the sub-scanning direction. In the second embodiment, resolution conversion is conversion from 2400 dpi in the main scanning direction and the sub-scanning direction into 1200 dpi in the main scanning direction and 2400 dpi in the sub-scanning direction, and thus the resampling interval in the main scanning direction is set to two (=2400/1200) pixels, in other words, every other pixel.

Figure 17B:
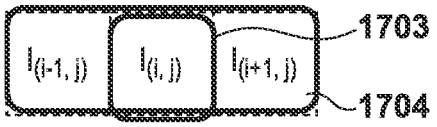

FIG. 17B is a diagram showing an example of the processing rectangle 1704 for a product-sum operation.

Figure 17C:
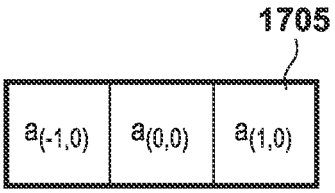
Figure 17D:
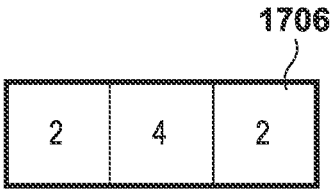

In the second embodiment, the processing rectangle 1704 for a product-sum operation is made up of three pixels (3×1), but there is no limitation thereto. Also, FIG. 17C is a diagram showing product-sum operation coefficients 1705 within the processing rectangle 1704 that is used for a product-sum operation, and FIG. 17D is a diagram showing an example thereof.

As described above, the processing rectangle 1704 is made up of three pixels in total centered on the pixel of interest 1703. The product-sum operation coefficients 1705 include three coefficients a(−1,0), a(0,0), and a(1,0) corresponding to the three pixels that make up the processing rectangle 1704. When the coordinates of the pixel of interest 1703 are defined as (i, j), and the value of the pixel is defined as I(i, j), output OUT is obtained from Expression 1 below as a result of a product-sum operation.

$$OUT=7/\Sigma_{k=-1}{}^{1}\alpha_{(k,0)}\Sigma_{k=-1}{}^{1}I_{(i+k,j)}\alpha_{(k,0)} \quad \text{Expression 1}$$

Specifically, the value of the pixel I(i, j) is a binary value of 0 or 1, and thus a product of a pixel value of the processing rectangle 1704 and the product-sum operation coefficient 1705 corresponding to the coordinates of the pixel is totaled for the three pixels, and the output OUT is normalized to a maximum value "7" of a 3-bit signal. Accordingly, the number of gradations of image data can be converted from two values into eight values while converting the resolution of image data from 2400×2400 dpi to 1200×2400 dpi.

FIG. 17D shows a view illustrating an example of the product-sum operation coefficients in the second embodiment.

For example, by performing a product-sum operation using product-sum operation coefficients indicated by 1706 in FIG. 17D, an effect of known spot multiplexing is obtained, and printing can be performed at a resolution higher than the actual resolution in a pseudo manner. In the second embodiment, the print unit 206 can form (print) an image of 2400×2400 dpi in a pseudo manner using image data of 1200×2400 dpi.

Next, a flow of image processing that is performed by the image processing unit 207 according to the second embodiment will be described with reference to FIG. 16.

Figure 16:
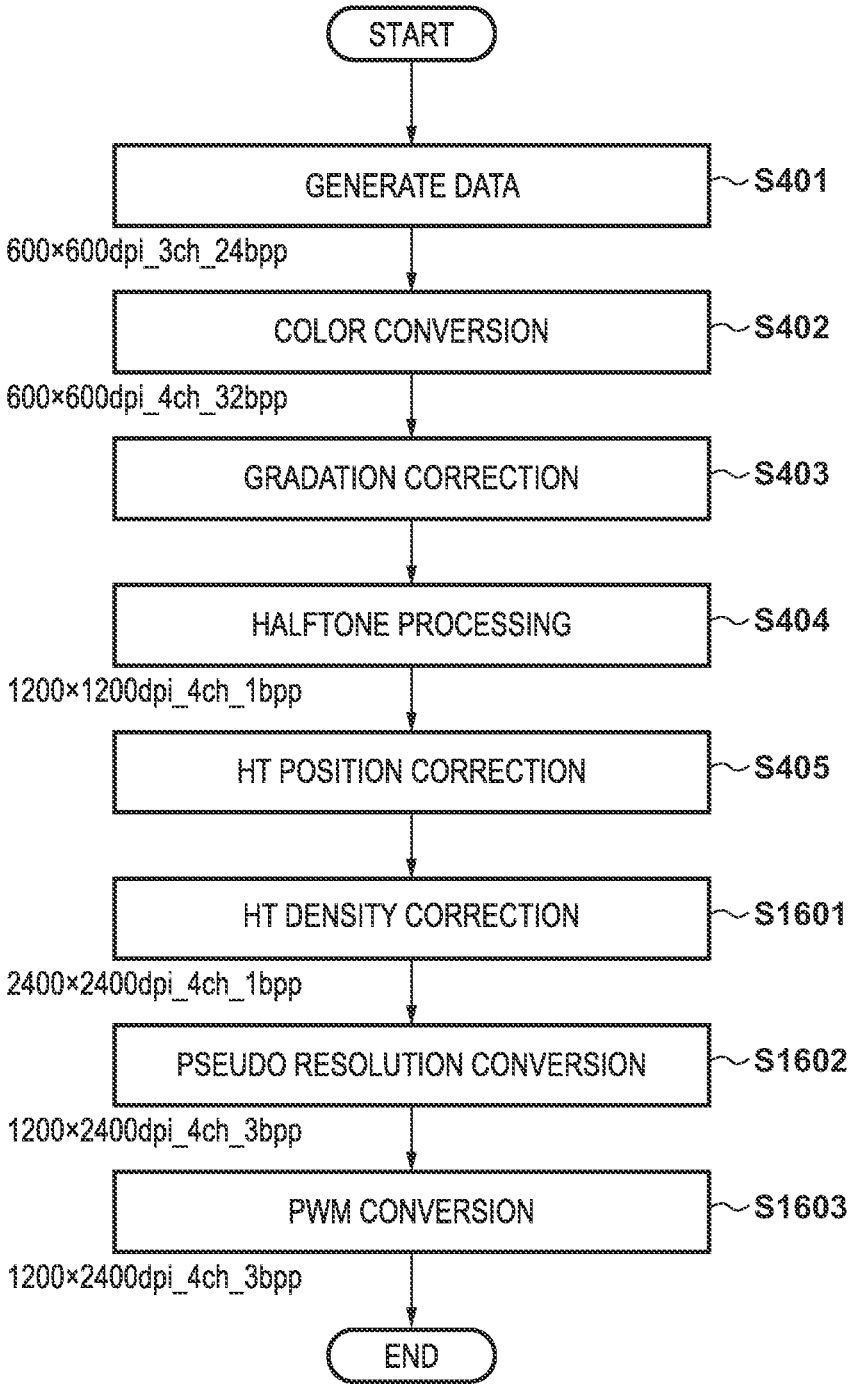
FIG. 16 is a flowchart for describing image processing that is performed by the image processing unit according to the second embodiment.

FIG. 16 is a flowchart for describing image processing that is performed by the image processing unit 207 according to the second embodiment. This processing is achieved by the CPU 208 deploying a program stored in the storage unit 204 to the RAM 210, and executing the program. Note that, in FIG. 16, the same reference numerals are assigned to processes common with those in the flowchart in FIG. 4 according to the above first embodiment, and a description thereof is omitted.

In step S405, after the CPU 208 controls the HT position correction unit 307 so as to perform position correction processing on halftone image data, the procedure advances to step S1601. In step S1601, the CPU 208 controls the HT density correction unit 308 so as to obtain information regarding the light amounts from the ROM 211 held in the LED line head 24 of each of the CMYK colors, and perform mask processing on the halftone image data for the main scanning positions based on the information regarding the light amounts. At this time, the HT density correction unit 308 performs HT density correction processing while doubling the resolution (1200 dpi) of the image data that has been input, both in the main scanning direction and the sub-scanning direction so as to perform HT density correction processing at a resolution of 2400 dpi that is higher than the printing resolution as described above. The image data that has undergone HT density correction processing at a resolution of 2400 dpi is then passed to the pseudo resolution conversion unit 1501.

Next, the procedure advances to step S1602, where the CPU 208 controls the pseudo resolution conversion unit 1501 so as to perform pseudo resolution conversion processing on the 2400 dpi_1-bit image data that has been received. The image data is then converted into image data whose resolution is 1200 dpi in the main scanning direction and 2400 dpi in the sub-scanning direction, which is the same as the printing resolution at which the print unit 206 can perform printing, and is passed to the PWM conversion unit 309. Next, the procedure advances to step S1603, where the CPU 208 controls the PWM conversion unit 309 so as to convert the received image data of a resolution of 1200×2400 dpi_3 bits into PWM signal data indicating a time of exposure of the photosensitive member 22 that is performed by the LED light emitting devices 43, and pass the data to the output unit 306.

Next, a flow of processing that is performed by the HT density correction unit 308 according to the second embodiment will be described.

In the second embodiment, mask processing is performed while doubling the resolution (1200 dpi) of input halftone image data both in the main scanning direction and the sub-scanning direction so as to perform HT density correction processing at a resolution of 2400 dpi that is higher than the printing resolution. In addition, a mask pattern is generated at a resolution of 2400 dpi in accordance with the processing resolution in mask processing.

Figure 18:
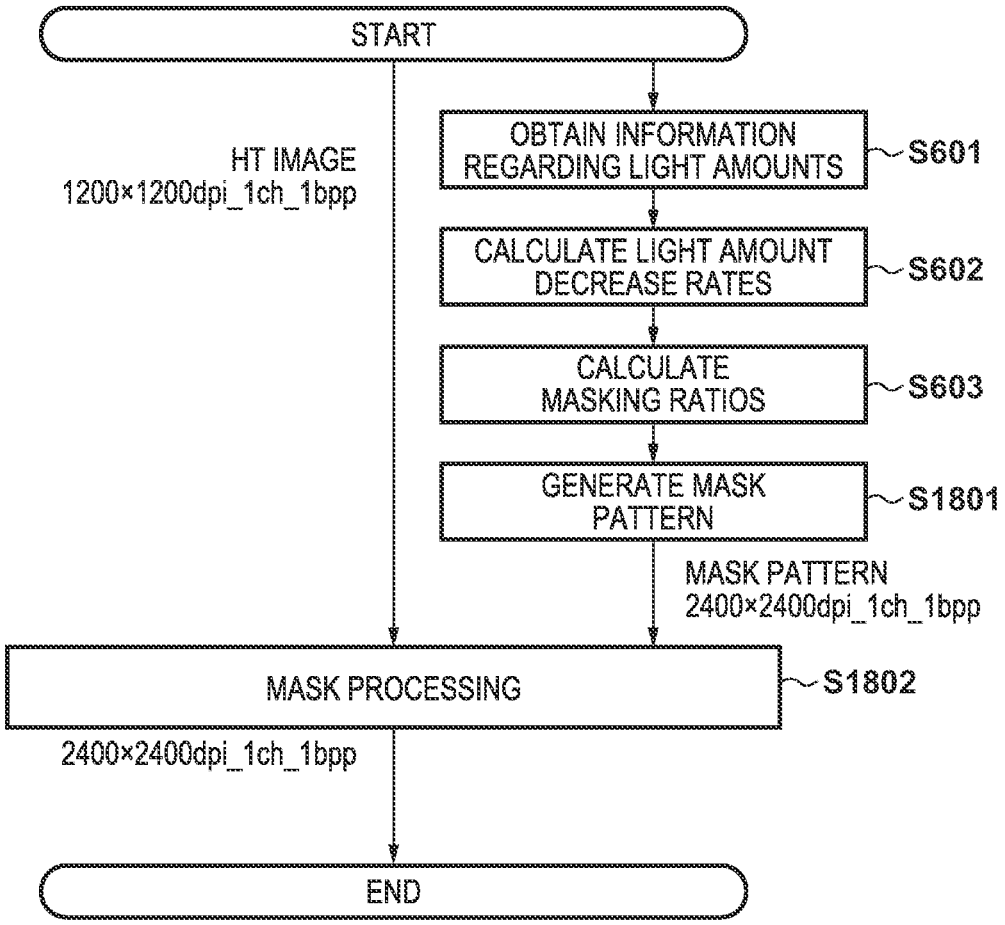
FIG. 18 is a flowchart for describing image processing that is performed by an HT density correction unit according to the second embodiment.

FIG. 18 is a flowchart for describing image processing that is performed by the HT density correction unit 308 according to the second embodiment. This processing is achieved by the CPU 208 deploying a program stored in the storage unit 204 to the RAM 210, and executing the program. Note that, in FIG. 18, the same reference numerals are assigned to processes common with those in the flowchart in FIG. 6 according to the above first embodiment, and a description thereof is omitted.

In step S603, the CPU 208 controls the HT density correction unit 308 so as to obtain masking ratios that are in accordance with light amount decrease rates, using the masking ratio conversion table shown in FIG. 7, and, after that, the procedure advances to step S1801. In step S1801, the CPU 208 controls the HT density correction unit 308 so as to generate a mask pattern that is based on the masking ratios obtained for the respective main scanning positions. Specifically, the mask pattern is generated by performing halftone processing by a dither method using the masking ratios and the threshold matrix for generating a mask pattern shown in FIG. 13A. This corresponds to halftone processing that is performed by the halftone processing unit 305. Here, for example, if the thresholds in the threshold matrix are 10 bits, the light amount decrease rates (=masking ratios) in FIG. 12 are normalized to 10-bit signal values, which are compared with the thresholds of the threshold matrix, and thereby a mask pattern of binary values is generated. A mask pattern, in which, at each position, if the light amount decrease signal is larger than the threshold, 1 is set (masking is performed), and if the light amount decrease signal is smaller than the threshold, 0 is set (masking is not performed), is generated. At this time, in the second embodiment, since the mask pattern is generated by performing resolution conversion into 2400 dpi, comparison with the thresholds of the threshold matrix is performed while doubling the light amount decrease signals both in the main scanning direction and the sub-scanning direction and repeatedly referencing the threshold matrix.

Next, the procedure advances to step S1802, where the CPU 208 controls the HT density correction unit 308 so as to perform mask processing on the halftone image received from the HT position correction unit 307, using the mask pattern generated at a resolution of 2400 dpi. Note that, in the second embodiment, a halftone image is enlarged twice both in the main scanning direction and the sub-scanning direction to 2400 dpi, and mask processing is carried out using a mask pattern having a resolution of 2400 dpi. The image data that has undergone density correction through mask processing is then passed to the pseudo resolution conversion unit 1501. By performing mask processing at a resolution of 2400 dpi that is higher than the printing resolution in this manner, mask positions are scattered, and it is possible to prevent collapse of the halftone dot structure caused by the mask.

FIG. 19A to 19D are diagrams showing an example of mask processing and pseudo resolution conversion processing at a resolution 2400 dpi according to the second embodiment.

Figure 19A:
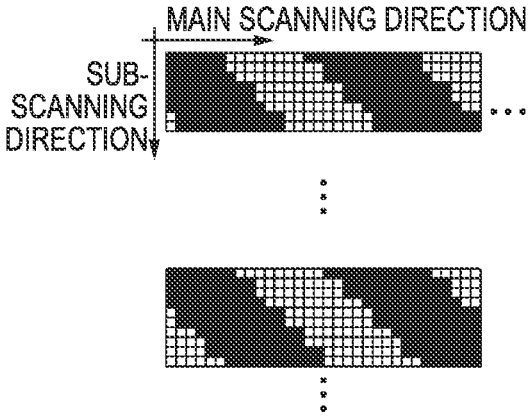
FIGS. 19A to 19D are diagrams showing an example of mask processing and pseudo resolution conversion processing at a resolution of 2400 dpi according to the second embodiment.
Figure 19B:
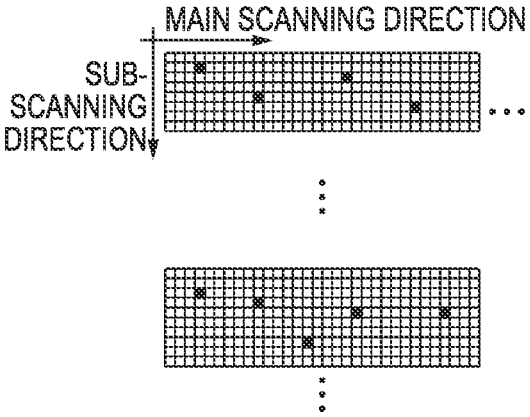
Figure 19C:
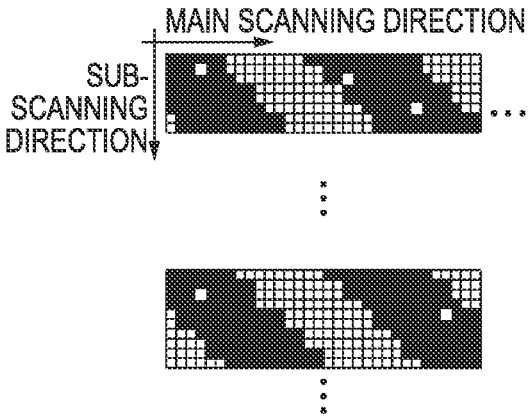
Figure 19D:
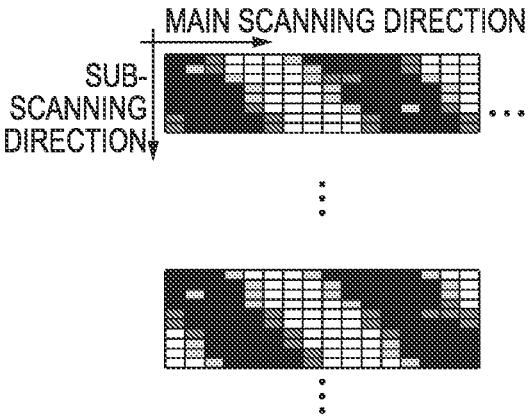

FIG. 19A shows a view illustrating a portion of a halftone image, and FIG. 19B shows a view illustrating a mask pattern generated based on masking ratios at positions corresponding to the halftone image. FIG. 19C shows a view illustrating an example of image data that has undergone mask processing in which the mask image in FIG. 19B is inverted and a logical product of the halftone image in FIG. 19A and the inverted mask image in FIG. 19B is obtained. FIG. 19D shows a view illustrating a state where pseudo resolution conversion processing is performed on image data (1 bit of resolution 2400×2400 dpi per pixel) in FIG. 19C that has undergone mask processing, 1 pixel is converted into horizontally long 3-bit data of 1200×2400 dpi.

In this manner, mask processing is performed at a resolution higher than the printing resolution, and the resolution of the halftone image data is then returned to the printing resolution through pseudo resolution conversion processing. As a result, a masked portion that is blanked white is blurred, and a local mask amount can be suppressed. Accordingly, it is possible to perform density adjustment of the image while suppressing deterioration of the image due to mask processing.

As described above, according to the second embodiment, based on information regarding the light amounts of the light emitting devices of LED line heads, mask processing is performed on halftone image data that is in positional correspondence with the light emitting device, at a resolution higher than the printing resolution, and density correction is performed. After that, pseudo resolution conversion processing is executed and the resolution is returned to the printing resolution. By executing mask processing after increasing the resolution of image data that has undergone halftone processing, it is possible to suppress the scale of the circuit compared with a case where the resolution of multi-value image data is increased. Furthermore, it is possible to prevent occurrence of contrasting density (streaks and unevenness) caused by light amount differences of light emitting device while preventing negative effects (e.g., break of halftone dot shape) caused by mask processing.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-160600, filed Aug. 29, 2018, which is hereby incorporated by reference herein in its entirety.

What is claimed is:

1. An image forming apparatus comprising:

a printer unit that prints an image on a sheet using a line head in which a plurality of light emitting devices are arranged;

a storage that stores information regarding light amounts corresponding to the light emitting devices of the line head;

a memory that stores instructions; and a processor that executes the instructions stored in the memory to:

generate a mask pattern based on the information regarding the light amounts obtained from the storage and a target light amount, and execute mask processing on halftone image data that is in positional correspondence with the light emitting devices using the generated mask pattern.

2. The image forming apparatus according to claim 1, wherein, if the information regarding the light amounts is larger than the target light amount, the processor, in generation of the mask pattern, obtains light amount decrease rates for bringing the information regarding the light amounts close to the target light amount, obtains masking ratios by referencing a table that stores masking ratios corresponding to the light amount decrease rates, and generates the mask pattern using the obtained masking ratios and a threshold matrix for generating a mask pattern.

3. The image forming apparatus according to claim 2, wherein the processor, in the generation of the mask pattern, generates the mask pattern by shifting, in a main scanning direction, a main scanning position at which the threshold matrix is to be applied, with respect to a width of the threshold matrix in a sub-scanning direction.

4. The image forming apparatus according to claim 3, wherein the width of the threshold matrix in the sub-scanning direction and an amount of the shift are mutually prime.

5. The image forming apparatus according to claim 2, wherein the processor, in executing the mask processing, executes, at main scanning positions corresponding to the respective light emitting devices, mask processing for thinning out pixels corresponding to the light amount decrease rates from among pixels corresponding to the width of the threshold matrix in a sub-scanning direction.

6. The image forming apparatus according to claim 1, wherein the processor executes the instructions stored in the memory further to:

correct gradation of image data, and execute halftone processing on multi-value image data whose gradation has been corrected, wherein the halftone image data is generated by the halftone processing.

7. The image forming apparatus according to claim 6, wherein the processor, in the halftone processing, converts a resolution of the image data whose gradation has been corrected into a resolution corresponding to an arrangement of the light emitting devices of the line head.

8. The image forming apparatus according to claim 1, wherein the processor, in executing the mask processing, executes the mask processing at a resolution higher than the resolution corresponding to the arrangement of the light emitting devices of the line head, and wherein the processor executes the instructions stored in the memory further to:

return image data that has undergone the mask processing to the resolution corresponding to the arrangement of the light emitting devices of the line head.

9. The image forming apparatus according to claim 2, wherein the mask pattern and the threshold matrix represent a pattern having a blue noise characteristic.

10. A method of controlling an image forming apparatus that includes a line head in which a plurality of light emitting devices are arranged and a memory that stores information regarding light amounts corresponding to the light emitting devices of the line head, and forms an image using the line head, the method comprising:

generating a mask pattern based on the information regarding the light amounts obtained from the memory and a target light amount, and executing mask processing on halftone image data that is in positional correspondence with the light emitting devices using the mask pattern generated in the generating.

11. A non-transitory computer-readable storage medium storing a program for causing a processor to execute a method of controlling an image forming apparatus that includes a line head in which a plurality of light emitting devices are arranged and a memory that stores information regarding light amounts corresponding to the light emitting devices of the line head, and forms an image using the line head, the method comprising:

generating a mask pattern based on the information regarding the light amounts obtained from the memory and a target light amount, and executing mask processing on halftone image data that is in positional correspondence with the light emitting devices using the mask pattern generated in the generating.

* * * * *